US009783757B2

(12) United States Patent
Matsui et al.

(10) Patent No.: US 9,783,757 B2
(45) **Date of Patent: *Oct. 10, 2017**

(54) POLY(METH)ACRYLATE-BASED VISCOSITY INDEX IMPROVER, LUBRICANT ADDITIVE AND LUBRICANT COMPOSITION CONTAINING VISCOSITY INDEX IMPROVER

(71) Applicant: JX NIPPON OIL & ENERGY CORPORATION, Tokyo (JP)

(72) Inventors: Shigeki Matsui, Tokyo (JP); Hiroya Miyamoto, Tokyo (JP); Hiromitsu Matsuda, Tokyo (JP); Kazuo Tagawa, Tokyo (JP); Akira Takagi, Tokyo (JP); Ryuichi Ueno, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/413,573

(22) PCT Filed: Jul. 24, 2013

(86) PCT No.: PCT/JP2013/070091

§ 371 (c)(1),
(2) Date: Jan. 8, 2015

(87) PCT Pub. No.: WO2014/017555

PCT Pub. Date: Jan. 30, 2014

(65) Prior Publication Data

US 2015/0203781 A1 Jul. 23, 2015

(30) Foreign Application Priority Data

| | | |
|---|---|---|
| Jul. 24, 2012 | (JP) | 2012-163619 |
| Jul. 24, 2012 | (JP) | 2012-163622 |
| Jul. 24, 2012 | (JP) | 2012-163624 |
| Apr. 5, 2013 | (JP) | 2013-079816 |
| Apr. 5, 2013 | (JP) | 2013-079828 |
| Apr. 5, 2013 | (JP) | 2013-079829 |
| Apr. 5, 2013 | (JP) | 2013-079830 |
| Apr. 5, 2013 | (JP) | 2013-079832 |
| Jul. 5, 2013 | (JP) | 2013-142010 |
| Jul. 5, 2013 | (JP) | 2013-142021 |

(51) Int. Cl.
*C10M 119/12* (2006.01)
*C10M 145/10* (2006.01)
(Continued)

(52) U.S. Cl.
CPC .. *C10M 145/14* (2013.01); *C10M 2203/1025* (2013.01); *C10M 2207/289* (2013.01);
(Continued)

(58) Field of Classification Search
CPC ..... C10M 145/14; C10M 2207/289; C10M 2223/045; C10M 2215/28;
(Continued)

(56) References Cited

U.S. PATENT DOCUMENTS

| | | | | |
|---|---|---|---|---|
| 4,496,691 | A * | 1/1985 | Proux | C08F 220/18 508/221 |
| 4,756,843 | A * | 7/1988 | Jarrin | C08F 220/18 508/472 |
| 4,844,829 | A | 7/1989 | Wilburn et al. | |
| 5,622,924 | A | 4/1997 | Sakai et al. | |
| 5,955,405 | A | 9/1999 | Liesen et al. | |
| 6,639,034 | B2 * | 10/2003 | Sivik | C08F 220/12 526/264 |
| 8,163,682 | B2 | 4/2012 | Stoehr et al. | |
| 8,513,172 | B2 | 8/2013 | Baum et al. | |
| 8,778,857 | B2 | 7/2014 | Growcott | |
| 2004/0092409 | A1 | 5/2004 | Liesen | |

(Continued)

FOREIGN PATENT DOCUMENTS

| | | |
|---|---|---|
| CN | 1891804 | 1/2007 |
| CN | 101087812 | 12/2007 |

(Continued)

OTHER PUBLICATIONS

Office Action issued in Chinese Counterpart Patent Appl. No. 201380034032.7, dated Sep. 14, 2015.

(Continued)

*Primary Examiner* — Pamela H Weiss
(74) *Attorney, Agent, or Firm* — Greenblum & Bernstein, P.L.C.

(57) ABSTRACT

The present invention provides a poly(meth)acrylate-based viscosity index improver comprising a core portion and three or more arm portions, wherein each of the arm portions consists of a polymer chain comprising a structural unit represented by the following formula (1), and one end of the polymer chain is bonded to the core portion, and wherein a weight-average molecular weight Mw is 100000 or more, and a ratio of the weight-average molecular weight Mw to a number average molecular weight Mn, Mw/Mn, is 1.6 or less.

(1)

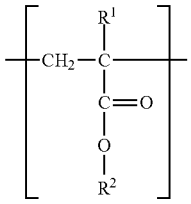

[$R^1$ represents hydrogen or a methyl group, and $R^2$ represents a C1 to C36 alkyl group.]

3 Claims, No Drawings

(51) Int. Cl.
*C10N 30/02* (2006.01)
*C10M 145/14* (2006.01)

(52) U.S. Cl.
CPC . *C10M 2209/084* (2013.01); *C10M 2215/064* (2013.01); *C10M 2215/28* (2013.01); *C10M 2219/024* (2013.01); *C10M 2219/046* (2013.01); *C10M 2219/106* (2013.01); *C10M 2223/04* (2013.01); *C10M 2223/045* (2013.01); *C10N 2210/02* (2013.01); *C10N 2220/021* (2013.01); *C10N 2220/022* (2013.01); *C10N 2220/029* (2013.01); *C10N 2230/02* (2013.01); *C10N 2230/06* (2013.01); *C10N 2230/54* (2013.01); *C10N 2230/68* (2013.01); *C10N 2240/042* (2013.01); *C10N 2240/044* (2013.01); *C10N 2240/045* (2013.01); *C10N 2240/10* (2013.01)

(58) Field of Classification Search
CPC ..... C10M 2209/084; C10M 2219/046; C10M 2219/106; C10M 2215/064; C10M 2223/04; C10M 2203/1025; C10M 2219/024; C10N 2240/10; C10N 2230/06; C10N 2220/022; C10N 2220/029; C10N 2240/045; C10N 2240/044; C10N 2210/02; C10N 2240/042; C10N 2230/02; C10N 2230/68; C10N 2230/54; C10N 2220/021
See application file for complete search history.

(56) References Cited

U.S. PATENT DOCUMENTS

| | | | | |
|---|---|---|---|---|
| 2004/0176256 | A1 | 9/2004 | Kurosawa et al. | |
| 2006/0135378 | A1 | 6/2006 | Takahashi et al. | |
| 2007/0082827 | A1 | 4/2007 | Schmidt et al. | |
| 2007/0244018 | A1* | 10/2007 | Visger | C08F 293/00 508/545 |
| 2008/0020952 | A1 | 1/2008 | Yagishita | |
| 2008/0146475 | A1 | 6/2008 | Mueller et al. | |
| 2008/0280793 | A1 | 11/2008 | Tequi et al. | |
| 2009/0118150 | A1* | 5/2009 | Baum | C08F 2/38 508/264 |
| 2009/0209440 | A1 | 8/2009 | Tipton et al. | |
| 2009/0221461 | A1 | 9/2009 | Visger et al. | |
| 2009/0270285 | A1 | 10/2009 | Baker et al. | |
| 2009/0305068 | A1 | 12/2009 | Morishita et al. | |
| 2010/0004149 | A1 | 1/2010 | Johnson et al. | |
| 2010/0022728 | A1 | 1/2010 | Yamago et al. | |
| 2010/0035774 | A1 | 2/2010 | Growcott | |
| 2010/0167970 | A1 | 7/2010 | Stoehr et al. | |
| 2010/0190671 | A1 | 7/2010 | Stoehr et al. | |
| 2011/0003725 | A1 | 1/2011 | Matsui et al. | |
| 2011/0218131 | A1 | 9/2011 | Tsujimoto et al. | |
| 2011/0237477 | A1 | 9/2011 | Tagawa et al. | |
| 2011/0306529 | A1 | 12/2011 | Schober et al. | |
| 2012/0046207 | A1 | 2/2012 | Mueller et al. | |
| 2012/0071374 | A1 | 3/2012 | Yaguchi et al. | |
| 2012/0071375 | A1 | 3/2012 | Yaguchi et al. | |
| 2012/0245068 | A1 | 9/2012 | Scanlon | |
| 2012/0283157 | A1 | 11/2012 | Matsui et al. | |
| 2012/0283159 | A1 | 11/2012 | Matsui et al. | |
| 2012/0289444 | A1* | 11/2012 | Schober | C10M 161/00 508/287 |
| 2012/0302477 | A1 | 11/2012 | Langston et al. | |
| 2012/0329694 | A1 | 12/2012 | Gelder et al. | |
| 2013/0310291 | A1 | 11/2013 | Baum et al. | |

FOREIGN PATENT DOCUMENTS

| | | | | |
|---|---|---|---|---|
| CN | 101087823 | | 12/2007 | |
| CN | 101189268 | | 5/2008 | |
| CN | 101484557 | A | 7/2009 | |
| CN | 101654635 | | 2/2010 | |
| CN | 101687963 | | 3/2010 | |
| CN | 101883839 | | 11/2010 | |
| CN | 101883840 | | 11/2010 | |
| CN | 102177227 | | 9/2011 | |
| CN | 102295972 | | 12/2011 | |
| CN | 102459546 | A | 5/2012 | |
| CN | 102712869 | A | 10/2012 | |
| EP | 0569639 | A1 * | 11/1993 | C08F 2/00 |
| EP | 2 474 602 | | 7/2012 | |
| EP | 2 522 709 | | 11/2012 | |
| JP | S54-070305 | A | 6/1979 | |
| JP | S54-149704 | A | 11/1979 | |
| JP | 2-500528 | | 2/1990 | |
| JP | 3-100099 | | 4/1991 | |
| JP | 6-145258 | | 5/1994 | |
| JP | 6-306384 | | 11/1994 | |
| JP | 7-48421 | | 2/1995 | |
| JP | 7-62372 | | 3/1995 | |
| JP | 7-300596 | | 11/1995 | |
| JP | 8-302378 | | 11/1996 | |
| JP | H09-048988 | A | 2/1997 | |
| JP | H10-077494 | A | 3/1998 | |
| JP | H11-286520 | A | 10/1999 | |
| JP | 2000-63439 | | 9/2000 | |
| JP | 2001-279287 | | 10/2001 | |
| JP | 2002-129182 | | 5/2002 | |
| JP | 2002-302687 | | 10/2002 | |
| JP | 2003-147332 | | 5/2003 | |
| JP | 2003-292938 | | 10/2003 | |
| JP | 2004-124080 | | 4/2004 | |
| JP | 2004-149794 | | 5/2004 | |
| JP | 2004-513997 | A | 5/2004 | |
| JP | 2004-169029 | | 6/2004 | |
| JP | 2005-023147 | A | 1/2005 | |
| JP | 2005-187736 | | 7/2005 | |
| JP | 2005-247978 | | 9/2005 | |
| JP | 2006-131854 | A | 5/2006 | |
| JP | 2007-512413 | | 5/2007 | |
| JP | 2007-262239 | A | 10/2007 | |
| JP | 2008-88215 | | 4/2008 | |
| JP | 2008-518051 | | 5/2008 | |
| JP | 2008-518052 | | 5/2008 | |
| JP | 2009-7562 | | 1/2009 | |
| JP | 2009-506179 | | 2/2009 | |
| JP | 2009-510178 | | 3/2009 | |
| JP | 2009-74068 | | 4/2009 | |
| JP | 2009-155639 | A | 7/2009 | |
| JP | 2009-173921 | A | 8/2009 | |
| JP | 2009-534518 | | 9/2009 | |
| JP | 2009-534519 | | 9/2009 | |
| JP | 2009-534521 | | 9/2009 | |
| JP | 2009-536686 | | 10/2009 | |
| JP | 2009-256665 | A | 11/2009 | |
| JP | 2010-37421 | | 2/2010 | |
| JP | 2010-532805 | | 10/2010 | |
| JP | 2011-21056 | | 2/2011 | |
| JP | 2011-127029 | | 6/2011 | |
| JP | 2011-140572 | | 7/2011 | |
| JP | 2011-140573 | A | 7/2011 | |
| JP | 2012-041559 | A | 3/2012 | |
| JP | 2012-197399 | A | 10/2012 | |
| JP | 2013-203913 | | 10/2013 | |
| WO | 2006/009083 | A1 | 1/2006 | |
| WO | 2007/127615 | | 11/2007 | |
| WO | 2007/127660 | | 11/2007 | |
| WO | 2009/072524 | A1 | 6/2009 | |
| WO | 2010/041692 | A1 | 4/2010 | |
| WO | 2011/134694 | A1 | 11/2011 | |
| WO | 2011/161908 | A1 | 12/2011 | |
| WO | 2012/076676 | | 6/2012 | |
| WO | 2012/128350 | A1 | 9/2012 | |
| WO | 2012/153547 | A1 | 11/2012 | |

(56) References Cited

FOREIGN PATENT DOCUMENTS

OTHER PUBLICATIONS

Office Action from Chinese Application No. 201380033976.2, which was mailed on Sep. 6, 2015.
Office Action issued in Chinese Counterpart Patent Appl. No. 201380038893.2, dated Nov. 3, 2015.
Office Action issued in Chinese Counterpart Patent Appl. No. 201380039481.0, dated Dec. 3, 2015.
XP002749051, "Database WPI Week 200916," *Thomson Scientific*, London, GB; AN 2009-B46415, Jan. 15, 2009, abstract of JP2009-7562.
Extended Search Report issued by European Patent Office (EPO) in EPO Patent Application No. 13822656.8, dated Feb. 10, 2016.
Extended Search Report issued by European Patent Office (EPO) in EPO Patent Application No. 13823712.8, dated Feb. 5, 2016.
Tang, Xiaodong, "Action Principle of Petroleum Processing Aids," *Petroleum Industry Press*, pp. 153-154, Nov. 30, 2004, along with a partial English translation thereof.
Office Action issued in Chinese Application No. 201380034032.7, dated Feb. 14, 2016.
U.S. Office action issued with respect to U.S. Appl. No. 14/413,773, mail date is May 26, 2016.
European Search Report issued with respect to application No. 13823599.9, mail date is Jun. 10, 2016.
Japanese Office Action issued with respect to application No. P2014-526979, mail date is Jul. 12, 2016.
US Office Action issued with respect to U.S. Appl. No. 14/416,339, mail date is Jul. 8, 2016.
Chinese Office Action issue with respect to application No. 201380033985.1, mail date is Jun. 30, 2016.
Extended European Search Report for Application No. 13823599.9.-1352, mailed Jun. 10, 2015.
Thomas P. Davis et al., "Handbook of Radical Polymerization", John Wiley & Sons, Inc. , 2002, pp. 463-690.
Search report from International Search Report for Appl. No. PCT/JP2013/070088, mail date is Oct. 29, 2013.
International Preliminary Report on Patentability for Appl. No. PCT/JP2013/070091 , mail date is Feb. 5, 2015.
International Preliminary Report on Patentability for Appl. No. PCT/JP2013/070096, mail date is Feb. 5, 2015.
Search report from International Search Report for Appl. No. PCT/JP2013/070096 , mail date is Oct. 29, 2013.
Search report from International Search Report for Appl. No. PCT/JP2013/070100, mail date is Oct. 29, 2013.
International Preliminary Report on Patentability for Appl. No. PCT/JP2013/070092, mail date is Feb. 5, 2015.
International Preliminary Report on Patentability for Appl. No. PCT/JP2013/070085, mail date is Feb. 5, 2015.
Search report from International Search Report for Appl. No. PCT/JP2013/070092, mail date is Oct. 29, 2013.
International Preliminary Report on Patentability for Appl. No. PCT/JP2013/070088, mail date is Feb. 5, 2015.
Search report from International Search Report for Appl. No. PCT/JP2013/070101, mail date is Oct. 29, 2013.
Search report from International Patent Appl. No. PCT/JP2013/070091, mail date is Oct. 8, 2013.
International Preliminary Report on Patentability for Appl. No. PCT/JP2013/070101, mail date is Feb. 5, 2015.
International Preliminary Report on Patentability for Appl. No. PCT/JP2013/070100, mail date is Feb. 5, 2015.
Search report from International Search Report for Appl. No. PCT/JP2013/070085, mail date is Sep. 17, 2013.
Japanese Office Action issued with respect to application No. P2013-142017, mail date is Jul. 19, 2016.
Chinese Office Action issued with respect to application No. 201380039460.9, mail date is Jul. 28, 2016.
Japanese Office Action issued with respect to Application No. P2013-142021, dated Oct. 18, 2016.
Japanese Office Action issued with respect to Application No. P2013-142017, dated Oct. 18, 2016.
Chinese Notice of Allowance issued with respect to Application No. 201380039460.9, dated Nov. 7, 2016.
US Office Action issued with respect to U.S. Appl. No. 14/413,773, dated Dec. 29, 2016.
Japanese Notice of Allowance issued with respect to Application No. 2014-526979, dated Apr. 4, 2017.
Office Action issued with respect to U.S. Appl. No. 14/416,194, dated Jan. 25, 2017.
Japanese Notice of Allowance issued with respect to Application No. P2016-152255, dated Apr. 25, 2017.
U.S. Office Action with respect to U.S. Appl. No. 14/416,194, dated Jun. 29, 2017.
Giorgos Karanikolopoulos et al., On the Polymerization of Alkyl Methacrylates with the Achiral Dimethylzirconocene Precursor Cp2ZrMe2, Macromolecules 2001, 34, 4697-4705.

* cited by examiner

POLY(METH)ACRYLATE-BASED VISCOSITY INDEX IMPROVER, LUBRICANT ADDITIVE AND LUBRICANT COMPOSITION CONTAINING VISCOSITY INDEX IMPROVER

TECHNICAL FIELD

The present invention relates to a poly(meth)acrylate-based viscosity index improver, a lubricating oil additive and a lubricating oil composition containing the viscosity index improver.

BACKGROUND ART

Conventionally, in the field of lubricating oils, improvement of lubricating oils has been studied from the viewpoint of an energy saving property. Especially in recent years, a trend toward the global environmental protection has increased, and a need for an energy saving property improving effect for lubricating oils has been further strengthened.

For example, in the case of lubricating oils used for internal combustion engines such as a vehicle engine (also referred to as "lubricating oils for an internal combustion engine" or "engine oils"), as one means of improving a fuel saving property, a method of increasing a viscosity index of a lubricating oil by adding a viscosity index improver to a lubricating base oil has been known.

Moreover, for example, in the case of lubricating oils used for transmissions of vehicles, such as ATF, MTF, and CVTF (also referred to as "lubricating oils for a transmission" or "drive system oils"), as one means of improving a fuel saving property, there is a method of decreasing viscosity resistance by lowering the viscosity of a lubricating oil for a transmission. However, when the viscosity of a lubricating oil for a transmission is lowered, other problems such as oil leak and seizure may arise.

Therefore, as another method for improving a fuel saving property, there is a method involving use of a viscosity index improver. This method increases the viscosity index of a lubricating oil for a transmission by using a viscosity index improver, and suppresses the viscosity increase in a low-temperature region while maintaining the viscosity in a high-temperature region.

Regarding a viscosity index improver, the use of various viscosity index improvers has been proposed, and in particular, the use of poly(meth)acrylate-based viscosity index improvers has been often proposed (for example, refer to Patent Literatures 1 to 7).

CITATION LIST

Patent Literature

Patent Literature 1: Japanese Patent Application Laid-Open No. 7-48421

Patent Literature 2: Japanese Patent Application Laid-Open No. 7-62372

Patent Literature 3: Japanese Patent Application Laid-Open No. 6-145258

Patent Literature 4: Japanese Patent Application Laid-Open No. 3-100099

Patent Literature 5: Japanese Patent Application Laid-Open No. 2002-302687

Patent Literature 6: Japanese Patent Application Laid-Open No. 2004-124080

Patent Literature 7: Japanese Patent Application Laid-Open No. 2005-187736

SUMMARY OF INVENTION

Technical Problem

However, for example, in lubricating oils for an internal combustion engine, in the case where the above-described conventional poly(meth)acrylate-based viscosity index improvers are used, there is a room for improvement in a high shear viscosity so as to achieve a practically sufficient fuel saving property. Especially, in 0 W-20 whose requirement for fuel saving property is high, there is a need to maintain the high shear viscosity at a high level to some extent at 150° C., and on the other hand, to lower the high shear viscosity at 100° C. In contrast, in the conventional poly(meth)acrylate-based viscosity index improvers, it is difficult to lower the high shear viscosity at 100° C. while maintaining the high shear viscosity at 150° C.

Furthermore, recently, maintenance of fuel consumption is needed in addition to a fuel saving property. Since shear stability of a viscosity index improver greatly influences maintenance of fuel consumption, as the viscosity index improver, one which excels in shear stability in addition to a fuel saving property is desirable. However, the conventional poly(meth)acrylate-based viscosity index improvers are not necessarily sufficient in terms of achieving both a fuel saving property and shear stability.

Moreover, for example, for lubricating oils for a transmission, as one cause of deterioration in a fuel saving property, there is friction loss of a gear in a driving device during power transmission. Therefore, if a lubricating oil whose viscosity resistance is low in a high shear condition can be achieved, friction loss can be decreased and a fuel saving property can be further improved. However, the above-described conventional viscosity index improvers attempt to improve a viscosity property in a high-temperature region and a low-temperature region by improving the viscosity index, and they are not considered to be sufficient in terms of a friction loss decreasing effect.

Furthermore, drive system oils are hardly exchanged, and thus, fuel saving sustainability is needed. Since shear stability of a viscosity index improver greatly influences fuel saving sustainability, as the viscosity index improver, the one which excels in shear stability in addition to a friction loss decreasing effect is desired. However, the conventional poly(meth)acrylate-based viscosity index improvers are not sufficient in terms of achieving both a friction loss decreasing effect and shear stability.

Therefore, an object of the present invention is to provide a viscosity index improver capable of achieving a fuel saving property, a lubricating oil additive and a lubricating oil composition containing the viscosity index improver.

Moreover, another object of the present invention is to provide a viscosity index improver capable of sufficiently lowering a high shear viscosity at 100° C. while maintaining a high shear viscosity at 150° C. and exhibiting high shear stability, a lubricating oil additive and a lubricating oil composition containing the viscosity index improver.

Furthermore, another object of the present invention is to provide a viscosity index improver which is capable of imparting a sufficient friction loss decreasing effect to a lubricating oil and is excellent in shear stability, a lubricating oil additive and a lubricating oil composition containing the viscosity index improver.

Solution to Problem

The present inventors made extensive research and found that a poly(meth)acrylate-based viscosity index improver which has a specific structure and in which the weight-average molecular weight Mw and the ratio of the weight-average molecular weight Mw to the number average molecular weight Mn, Mw/Mn satisfy specific conditions can sufficiently lower a high shear viscosity at 100° C. while maintaining a high shear viscosity at 150° C. and exhibits high shear stability, which leads to accomplish the present invention.

That is, the present invention provides a poly(meth) acrylate-based viscosity index improver comprising a core portion, and three or more arm portions, wherein each of the arm portions consists of a polymer chain comprising a structural unit represented by the following formula (1), and one end of the polymer chain is bonded to the core portion, and wherein the weight-average molecular weight Mw is 100000 or more, and the ratio of the weight-average molecular weight Mw to the number average molecular weight Mn, Mw/Mn, is 1.6 or less (hereinafter, referred to as "first poly(meth)acrylate-based viscosity index improver").

[Chemical Formula 1]

(1)

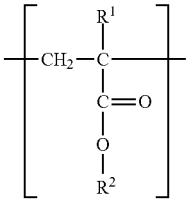

[In the formula (1), $R^1$ represents hydrogen or a methyl group, and $R^2$ represents a C1 to C36 alkyl group.]

Moreover, the present inventors made extensive research and found that a poly(meth)acrylate-based viscosity index improver which has a specific structure and in which the weight-average molecular weight and the ratio of the weight-average molecular weight Mw to the number average molecular weight Mn, Mw/Mn, satisfy specific conditions can impart a friction loss decreasing effect and is excellent in shear stability, which leads to accomplish the present invention.

That is, the present invention provides a poly(meth) acrylate-based viscosity index improver comprising a core portion, and three or more arm portions, wherein each of the arm portions consists of a polymer chain comprising a structural unit represented by the following formula (1), and one end of the polymer chain is bonded to the core portion, and wherein the weight-average molecular weight Mw is less than 100000, and the ratio of the weight-average molecular weight Mw to the number average molecular weight Mn, Mw/Mn, is 1.6 or less (hereinafter, referred to as "second poly(meth)acrylate-based viscosity index improver").

[Chemical Formula 2]

(1)

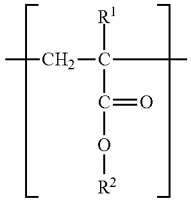

[In the formula (1), $R^1$ represents hydrogen or a methyl group, and $R^2$ represents a C1 to C36 alkyl group.]

Moreover, the present invention provides a lubricating oil additive comprising at least one selected from the above-described first poly(meth)acrylate-based viscosity index improver and second poly(meth)acrylate-based viscosity index improver.

Furthermore, the present invention provides a lubricating oil composition comprising a lubricating base oil, and at least one selected from the above-described first poly(meth) acrylate-based viscosity index improver and second poly (meth)acrylate-based viscosity index improver.

Advantageous Effects of Invention

According to the present invention, a viscosity index improver capable of achieving a fuel saving property, a lubricating oil additive and a lubricating oil composition containing the viscosity index improver can be provided.

Moreover, according to the present invention, a viscosity index improver capable of sufficiently lowering a high shear viscosity at 100° C. while maintaining a high shear viscosity at 150° C. and exhibiting high shear stability, a lubricating oil additive and a lubricating oil composition containing the viscosity index improver can be provided.

Furthermore, according to the present invention, a viscosity index improver which is capable of imparting a sufficient friction loss decreasing effect to a lubricating oil and is excellent in shear stability, a lubricating oil additive and a lubricating oil composition containing the viscosity index improver can be provided.

DESCRIPTION OF EMBODIMENTS

Hereinafter, preferred embodiments of the present invention will be described in detail, but the present invention is not limited to the following embodiments.

First Embodiment: First Poly(Meth)Acrylate-Based Viscosity Index Improver

A poly(meth)acrylate-based viscosity index improver according to the first embodiment comprises a core portion, and three or more arm portions each of which is composed of a polymer chain containing a structural unit represented by the following formula (1) and in each of which one end of the polymer chain is bonded to the core portion. The weight-average molecular weight Mw (hereinafter, just referred to as "Mw" in some cases) of the poly(meth) acrylate-based viscosity index improver is 100000 or more, and the ratio of the weight-average molecular weight Mw to the number average molecular weight Mn (hereinafter, just referred to as "Mn" in some cases), Mw/Mn (hereinafter, just referred to as "Mw/Mn" in some cases), is 1.6 or less.

[Chemical Formula 3]

(1)

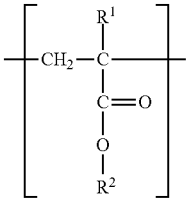

[In the formula (1), $R^1$ represents hydrogen or a methyl group, and $R^2$ represents a C1 to C36 alkyl group.]

$R^1$ may be either hydrogen or a methyl group, and is preferably a methyl group.

The number of carbon atoms of the alkyl group represented by $R^2$ is 1 or more and 36 or less as described above, preferably 1 to 30, more preferably 1 to 26, and further preferably 1 to 22 from the viewpoint of handleability and ease of manufacture. Moreover, the alkyl group represented by $R^2$ may be straight-chain or branched.

In the case where two or more structural units represented by the above formula (1) are contained in the polymer chain constituting the arm portion, $R^1$s and $R^2$s may be the same or different between the respective structural units. In the case where two or more structural units in which $R^2$s are different are contained, from the viewpoint of a fuel saving property, the polymer chain contains preferably 10 to 45 mass %, more preferably 15 to 45 mass %, and further preferably 20 to 45 mass % of the structural unit in which $R^2$ is a methyl group, based on the total amount of the structural units contained in the polymer chain. Moreover, from the viewpoint of solubility, the polymer chain preferably 10 mass % or more, more preferably 15 mass % or more, and further preferably 20 mass % or more of the structural unit in which $R^2$ is an alkyl group having 18 or more carbon atoms, based on the total amount of the structural units contained in the polymer chain.

The polymer chain may contain only the structural unit represented by the above formula (1), or may further contain a structural unit other than the structural unit represented by the above formula (1) in addition to the structural unit represented by the above formula (1). Moreover, between terminals of the polymer chain, one end is bonded to the core portion, and an atom to which the other end is bonded is not particularly limited. Among these polymer chains, a polymer chain containing only the structural unit represented by the above formula (1), in which one end is bonded to the core portion and the other end is bonded to a hydrogen atom, that is, a polymer chain represented by the following formula (2) is preferable.

[Chemical Formula 4]

(2)

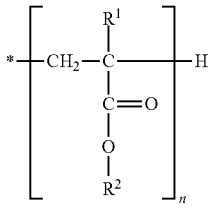

In the formula (2), $R^1$ represents hydrogen or a methyl group, $R^2$ represents a C1 to C36 alkyl group, and n represents an integer selected such that the Mw and the Mw/Mn of the poly(meth)acrylate-based viscosity index improver satisfy the above-described conditions. For example, n is an integer of 400 to 2000. Moreover, * represents a bonding hand with the core portion.

The weight-average molecular weight Mw per one arm portion is arbitrarily selected such that the Mw of the poly(meth)acrylate-based viscosity index improver satisfies the above-described condition, and it is preferably 10000 or more, more preferably 15000 or more, and further preferably 18000 or more.

The number average molecular weight Mn per one arm portion is arbitrarily selected such that the Mw/Mn of the poly(meth)acrylate-based viscosity index improver satisfies the above-described condition, and it is preferably 8000 or more, more preferably 12000 or more, and further preferably 15000 or more.

The weight-average molecular weight Mw of the poly (meth)acrylate-based viscosity index improver is 100000 or more, and it is preferably 125000 or more, more preferably 150000 or more, and further preferably 175000 or more from the viewpoint of a fuel saving property. The upper limit of Mw is not particularly limited, and the Mw is, for example, 500000 or less.

The number average molecular weight Mn of the poly (meth)acrylate-based viscosity index improver is arbitrarily selected such that the Mw/Mn satisfies the above-described condition. The Mn is preferably 75000 or more, more preferably 94000 or more, and further preferably 110000 or more from the viewpoint of a fuel saving property. The upper limit of Mn is not particularly limited, and the Mn is, for example, 300000 or less.

The Mw/Mn of the poly(meth)acrylate-based viscosity index improver is 1.6 or less, and it is preferably 1.5 or less, more preferably 1.4 or less, and further preferably 1.2 or less from the viewpoint of a fuel saving property. Moreover, in the manufacture, the Mw/Mn is preferably 1.00 or more, more preferably 1.01 or more, and further preferably 1.02 or more.

It is to be noted that "the weight-average molecular weight Mw", "the number average molecular weight Mn", and "the ratio Mw/Mn of the weight-average molecular weight Mw to the number average molecular weight Mn" in the present invention mean Mw, Mn, and Mw/Mn (converted values with polystyrene (standard sample)) obtained by GPC analysis. The Mw/Mn of the poly(meth)acrylate-based viscosity index improver and the Mw and the Mn per one arm portion can be measured as follows, for example.

A solution whose sample concentration was 2 mass % was prepared by dilution using tetrahydrofuran as a solvent. The sample solution was analyzed using GPC equipment (Waters Alliance2695). The analysis was carried out at the flow rate of the solvent of 1 ml/min, by using a column whose analyzable molecular weight is 10000 to 256000, and a refractive index as a detector. It is to be noted that the relationship between the column retention time and the molecular weight was determined using a polystyrene standard whose molecular weight is clear and a calibration curve was separately made, and after that, the molecular weight was determined from the obtained retention time. The molecular weight (Mw and Mn) of the arm can be calculated by dividing the obtained molecular weight (Mw and Mn) by the number of functional groups of an initiator.

The core portion is one derived from a compound having three or more functional groups which react with a carbon-carbon double bond of an acryloyl group. Examples of the compound having three or more functional groups which react with a carbon-carbon double bond of an acryloyl group include 1,1,1-tris(2-bromoisobutyloxymethylene)ethane, pentaerythritoltetrakis(2-bromoisobutyrate), and dipentaerythritolhexakis(2-bromoisobutyrate).

The number of the arm portions in the poly(meth)acrylate-based viscosity index improver corresponds to the number of the above-described functional groups. The number of the arm portions, that is, the number of the above-described functional groups is preferably 2 to 12, more preferably 2 to 8, and further preferably 3 to 6 from the viewpoint of shear stability.

Although the manufacturing method of the poly(meth) acrylate-based viscosity index improver according to the present embodiment is not particularly limited, examples thereof include a method in which a polymerization catalyst is added to a mixed solution containing an alkyl(meth) acrylate, an initiator, and a solvent to polymerize the alkyl (meth)acrylate.

As the alkyl(meth)acrylate, an alkyl(meth)acrylate represented by the following formula (3) can be used.

[Chemical Formula 5]

(3)

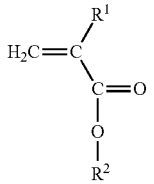

In the formula (3), $R^1$ represents hydrogen or a methyl group, and $R^2$ represents a C1 to C36 alkyl group.

$R^1$ is preferably a methyl group. The number of carbon atoms of the alkyl group represented by $R^2$ is preferably 1 to 30, more preferably 1 to 26, and further preferably 1 to 22.

As the alkyl(meth)acrylate, one of the alkyl(meth)acrylate represented by the above formula (3) can be used alone, or two or more thereof can be mixed to be used, and preferably, two or more thereof are mixed to be used. In the case two or more thereof are mixed to be used, the content of methyl(meth)acrylate in which $R^2$ is a methyl group is preferably 5 to 50 mass %, more preferably 10 to 50 mass %, and further preferably 20 to 45 mass % based on the total amount of the alkyl(meth)acrylate. Moreover, the content of an alkyl(meth)acrylate in which $R^2$ is an alkyl group having 18 or more carbon atoms is preferably 10 mass % or more, more preferably 15 mass % or more, and further preferably 20 mass % or more based on the total amount of the alkyl(meth)acrylate.

As the initiator, one derived from a compound which reacts with a carbon-carbon double bond of an acryloyl group and has three or more functional groups can be used, for example, 1,1,1-tris(2-bromoisobutyloxymethylene)ethane, pentaerythritoltetrakis(2-bromoisobutyrate), and dipentaerythritolhexakis(2-bromoisobutyrate) can be used.

As the solvent, for example, highly-refined mineral oils, anisole, toluene, and hydrocarbon-based synthetic oils can be used. Examples of a preferred solvent include highly-refined mineral oils and hydrocarbon-based synthetic oils.

As the polymerization catalyst, for example, copper(II) bromide, tris(2-pyridylmethyl)amine, azobisisobutyronitrile, and tin(II) 2-ethylhexanoate can be used. One of these polymerization catalysts may be used alone, or two or more thereof may be mixed to be used.

The reaction temperature upon polymerizing the alkyl (meth)acrylate can be arbitrarily selected. Examples of a preferred reaction temperature include 60 to 100° C. By making the reaction temperature be within the above-described range, the Mw/Mn of the obtained poly(meth)acrylate-based viscosity index improver becomes easy to be 1.6 or less. For example, when the reaction temperature is 60 to 80° C., the Mw/Mn tends to be 1.0 to 1.3, and when the reaction temperature is 80 to 100° C., the Mw/Mn tends to be 1.3 to 1.6.

The reaction time can be arbitrarily selected in accordance with the kinds and the amounts used of the alkyl(meth) acrylate, the polymerization reagent, the solvent, and the initiator, which are raw materials, reaction conditions such as a reaction temperature, and desired Mw and Mw/Mn of the poly(meth)acrylate. Examples of preferred reaction time include 10 to 14 hours.

The polymerization of the alkyl(meth)acrylate is preferably carried out in a nitrogen atmosphere.

Second Embodiment: Lubricating Oil Additive

A lubricating oil additive according to the second embodiment of the present invention contains a poly(meth)acrylate-based viscosity index improver comprising a polymer chain containing a structural unit represented by the above formula (1), wherein the weight-average molecular weight Mw is 100000 or more, and the ratio of the weight-average molecular weight Mw to the number average molecular weight Mn, Mw/Mn, is 1.6 or less. It is to be noted that the poly(meth) acrylate-based viscosity index improver in the present embodiment is the same as the viscosity index improver in the above-described first embodiment, and an overlapping explanation is omitted here.

The lubricating oil additive may consists of only the above-described poly(meth)acrylate-based viscosity index improver, or may be a mixture of the viscosity index improver and other additives (that is, additive composition). In the case where the lubricating oil additive is a mixture of the viscosity index improver and other additives, the mixing ratio thereof is not particularly limited and can be arbitrarily selected depending on the intended use.

Examples of the other additives include additives such as viscosity index improvers other than the above-described poly(meth)acrylate-based viscosity index improver, antioxidants, antiwear agents (or extreme pressure agents), corrosion inhibitors, rust-preventive agents, viscosity index improvers, pour-point depressants, demulsifiers, metal deactivators, antifoamers, and ashless friction modifiers. One of these additives can be used alone, or two or more thereof can be used in combination.

Examples of the viscosity index improvers other than the above-described poly(meth)acrylate-based viscosity index improver include poly(meth)acrylate-based viscosity index improvers other than the above-described poly(meth)acrylate-based viscosity index improver, polyisobutene-based viscosity index improvers, ethylene-propylene copolymer-based viscosity index improvers, and styrene-butadiene hydrogenated copolymer-based viscosity index improvers.

Examples of the antioxidants include ashless antioxidants such as phenolic or amine antioxidants, and metallic antioxidants such as zinc, copper, or molybdenum antioxidants.

Examples of the phenolic antioxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonyl phenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4-(N,N-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetrakis[3-(3,5-di-tert-butyl-4-hydroxyphenyl)propionate], octyl-3-(3,5-di-tert-butyl-4-hydroxyphenyl)propionate, stearyl 3-(3,5-di-tert-butyl-4-hydroxyphenyl)propionate, and octyl-3-(3-methyl-5-di-tert-butyl-4-hydroxyphenyl)propionate. Two or more thereof may be mixed to be used.

Examples of the amine antioxidants include known amine antioxidants generally used for lubricating oils, such as aromatic amine compounds, alkyldiphenylamines, alkylnaphthylamines, phenyl-α-naphthylamine, and alkylphenyl-α-naphthylamines.

Examples of the corrosion inhibitors include benzotriazole, tolyltriazole, thiadiazole, and imidazole compounds.

Examples of the rust-preventive agents include petroleum sulfonates, alkylbenzene sulfonates, dinonylnaphthalene sulfonates, alkenylsuccinic acid esters, and polyhydric alcohol esters.

Examples of the metal deactivators include imidazoline, pyrimidine derivatives, alkylthiadiazoles, mercaptobenzothiazole, benzotriazole or derivatives thereof, 1,3,4-thiadiazole polysulfide, 1,3,4-thiadiazolyl-2,5-bisdialkyldithiocarbamate, 2-(alkyldithio)benzimidazole, and β-(o-carboxybenzylthio)propionitrile.

Examples of the antifoamers include silicone oil whose kinematic viscosity at 25° C. is 1000 to 100000 $mm^2/s$, alkenylsuccinic acid derivatives, esters of polyhydroxy aliphatic alcohols and long-chain fatty acids, methylsalicylate, and o-hydroxybenzyl alcohol.

As the ashless friction modifiers, arbitrary compounds generally used as ashless friction modifiers for lubricating oils can be used, and examples thereof include ashless friction modifiers such as amine compounds, fatty acid esters, fatty acid amides, fatty acids, aliphatic alcohols, and aliphatic ethers, each of which has at least one alkyl group or alkenyl group having 6 to 30 carbon atoms, in particular straight-chain alkyl group or straight-chain alkenyl group having 6 to 30 carbon atoms in a molecule. Moreover, nitrogen-containing compounds and acid-modified derivatives thereof and the like described in Japanese Patent Application Laid-Open No. 2009-286831 and various ashless friction modifiers exemplified in International Publication No. WO 2005/037967 Pamphlet can also be used.

Furthermore, the lubricating oil additive according to the present embodiment may further contain a solvent. As the solvent, highly-refined mineral oils, solvent-refined mineral oils, and various synthetic oils can be used. Among them, it is preferable to use highly-refined mineral oils and hydrocarbon-based synthetic oils. In the case where the lubricating oil additive contains the solvent, the content of the solvent is preferably 5 to 75 mass %, and more preferably 30 to 60 mass % based on the total amount of the lubricating oil additive.

Third Embodiment: Lubricating Oil Composition

A lubricating oil composition according to the third embodiment contains a lubricating base oil, and a poly(meth)acrylate-based viscosity index improver comprising a polymer chain containing a structural unit represented by the above formula (1), wherein the weight-average molecular weight Mw is 100000 or more, and the ratio of the weight-average molecular weight Mw to the number average molecular weight Mn, Mw/Mn, is 1.6 or less. The lubricating oil composition according to the present embodiment includes an aspect containing a lubricating base oil and the lubricating oil additive according to the above-described second embodiment. The poly(meth)acrylate-based viscosity index improver in the present embodiment is the same as the poly(meth)acrylate-based viscosity index improvers in the above-described first embodiment and second embodiment, and furthermore, other additives and a solvent which can be contained in the lubricating oil composition are the same as the other additives and the solvent in the second embodiment, and an overlapping explanation is omitted here.

The lubricating base oil is not particularly limited, and lubricating base oils used for general lubricating oils can be used. Specifically, mineral lubricating base oils, synthetic lubricating base oils, a mixture in which two or more lubricating base oils selected therefrom are mixed at an arbitrary ratio and the like can be used.

Examples of the mineral lubricating base oils include those obtained by refining a lubricating oil fraction obtained by reduced-pressure distillation of an atmospheric residue obtained by atmospheric distillation of a crude oil by carrying out one or more treatment, such as solvent deasphalting, solvent extraction, hydrocracking, solvent dewaxing, and hydrorefining, and base oils manufactured by a method of isomerizing wax-isomerized mineral oils and GTL waxes (gas-to-liquid waxes).

Examples of the synthetic lubricating oils include polybutene or hydrides thereof; poly-α-olefins such as 1-octene oligomer and 1-decene oligomer, or hydrides thereof; diesters such as ditridecyl glutarate, di-2-ethylhexyl adipate, diisodecyl adipate, ditridecyl adipate, and di-2-ethylhexyl sebacate; polyol esters such as trimethylolpropane caprylate, trimethylolpropane pelargonate, pentaerythritol-2-ethylhexanoate, and pentaerythritol pelargonate; aromatic synthetic oils such as alkylnaphthalenes and alkylbenzenes, and mixtures thereof.

The kinematic viscosity at 100° C. of the lubricating base oil is preferably 2.5 to 10.0 $mm^2/s$, more preferably 3.0 to 8.0 $mm^2/s$, and further preferably 3.5 to 6.0 $mm^2/s$. Moreover, the viscosity index of the lubricating base oil is preferably 90 to 165, more preferably 100 to 155, and further preferably 120 to 150.

The saturated component of the lubricating base oil by chromatography analysis is preferably 80% or more, more preferably 85% or more, further preferably 90% or more, and most preferably 95% or more so as to make it easy to exert an effect of additives such as the poly(meth)acrylate-based viscosity index improver according to the first embodiment.

The content of the poly(meth)acrylate-based viscosity index improver according to the first embodiment is preferably 0.1 to 20.0 mass %, more preferably 0.5 to 15.0 mass %, and further preferably 1.0 to 10.0 mass % based on the total amount of the lubricating oil composition. When the content is the above-described lower limit or more, a sufficient effect of addition becomes easy to be obtained, and on the other hand, when the content is the above-described upper limit or less, shear stability increases and fuel consumption sustainability is improved.

The kinematic viscosity at 100° C. of the lubricating oil composition is preferably 3.0 to 16.3 $mm^2/s$, more preferably 3.5 to 12.5 $mm^2/s$, and further preferably 4.0 to 9.3 $mm^2/s$. When the kinematic viscosity at 100° C. is the above-described lower limit or more, a lubricating property becomes easy to be ensured, and on the other hand, when the kinematic viscosity at 100° C. is the above-described upper limit or less, a fuel saving property is further improved. It is to be noted that the kinematic viscosity at 100° C. in the present invention means a kinematic viscosity at 100° C. defined by JIS K-2283-1993.

The viscosity index of the lubricating oil composition is preferably 150 to 250, more preferably 160 to 240, and further preferably 170 to 230. When the viscosity index is the above-described lower limit or more, a fuel saving property can be further improved, and moreover, the low-temperature viscosity becomes easy to be lowered while maintaining the HTHS viscosity. On the other hand, when the viscosity index is the above-described upper limit or less, low-temperature fluidity, solubility of additives, and compatibility with a sealing material can be ensured. It is to be noted that the viscosity index in the present invention means a viscosity index defined by JIS K 2283-1993.

The HTHS viscosity at 150° C. of the lubricating oil composition is preferably 1.7 mPa·s or more, more preferably 2.0 mPa·s or more, further preferably 2.3 mPa·s or more, and most preferably 2.6 mPa·s or more. When the HTHS viscosity at 150° C. is the above-described lower limit or more, evaporation of the lubricating oil composition can be suppressed, and a lubricating property can be ensured. Moreover, the HTHS viscosity at 100° C. of the lubricating oil composition is preferably 5.2 mPa·s or less, more preferably 5.1 mPa·s or less, and further preferably 5.0 mPa·s or less. When the HTHS viscosity at 100° C. is the above-described upper limit or less, a higher fuel saving property can be obtained. It is to be noted that the HTHS viscosity at 150° C. or 100° C. in the present invention means a high temperature high shear viscosity at 150° C. or 100° C. defined by ASTM D-4683.

Shear stability of the lubricating oil composition is evaluated by, for example, a viscosity decreasing rate. The viscosity decreasing rate of the lubricating oil composition is preferably 5.2% or less, more preferably 5.1% or less, and further preferably 5.0% or less. When the viscosity decreasing rate is the above-described upper limit or less, a fuel saving property is excellent. It is to be noted that the viscosity decreasing rate in the present invention means a viscosity decreasing rate in an ultrasonic shear test, specifically, means a decreasing rate of a thickening property due to a viscosity index improver when performing evaluation in a condition where only a sample volume is increased, in conformity with JASO M347-95 (Automatic transmission fluids-Test method for shear stability).

More specifically, the viscosity decreasing rate means Permanent Shear Stability Index PSSI of a polymer, which is calculated based on a measured kinematic viscosity obtained by performing a shear test in conditions where the amplitude is 28 μm, the frequency is 10 kHz, the exposure time is 10 minutes, and the sample volume is 50 mL after carrying out power conditioning with a standard oil A defined in a test method of ASTM. PSSI is calculated from ((V1−V2)/V1×100)(%), based on the thickening property (V1) per the amount added of the viscosity index improver at 100° C. measured before the shear test, and the thickening property (V2) per the amount added of the viscosity index improver at 100° C. measured after the shear test.

The viscosity index improver according to the first embodiment, the lubricating oil additive according to the second embodiment, and the lubricating oil composition according to the third embodiment, which are described above, can be used in a wide range of fields such as lubricating oils for an internal combustion engine and drive system lubricating oils, and in particular, are useful in the field of lubricating oils for an internal combustion engine. Fuel of the internal combustion engine in this case may be either gasoline or diesel fuel.

Fourth Embodiment: Second Poly(Meth)Acrylate-Based Viscosity Index Improver

A poly(meth)acrylate-based viscosity index improver according to the fourth embodiment comprises a core portion, and three or more arm portions each of which is composed of a polymer chain containing a structural unit represented by the following formula (1) and in each of which one end of the polymer chain is bonded to the core portion. The weight-average molecular weight Mw (hereinafter, just referred to as "Mw" in some cases) of the poly(meth)acrylate-based viscosity index improver is less than 100000, and the ratio of the weight-average molecular weight Mw to the number average molecular weight Mn (hereinafter, just referred to as "Mn" in some cases), Mw/Mn (hereinafter, just referred to as "Mw/Mn" in some cases), is 1.6 or less.

[Chemical Formula 6]

(1)

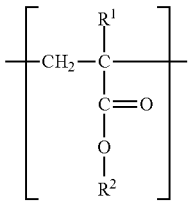

[In the formula (1), $R^1$ represents hydrogen or a methyl group, and $R^2$ represents a C1 to C36 alkyl group.]

$R^1$ may be either hydrogen or a methyl group, and is preferably a methyl group.

The number of carbon atoms of the alkyl group represented by $R^2$ is 1 or more and 36 or less as described above, preferably 1 to 30, more preferably 1 to 26, and further preferably 1 to 22 from the viewpoint of handleability and ease of manufacture. Moreover, the alkyl group represented by $R^2$ may be straight-chain or branched.

In the case where two or more structural units represented by the above formula (1) are contained in the polymer chain, $R^1$s and $R^2$s may be the same or different between the respective structural units. In the case where two or more structural units in which $R^2$s are different are contained, from the viewpoint of a viscosity-temperature property, the polymer chain contains preferably 10 to 45 mass %, more preferably 15 to 45 mass %, and further preferably 20 to 45 mass % of the structural unit in which $R^2$ is a methyl group, based on the total amount of the structural units contained in the polymer chain. Moreover, from the viewpoint of a fuel saving property, the polymer chain contains preferably 10 mass % or more, more preferably 15 mass % or more, and further preferably 20 mass % or more of the structural unit in which $R^2$ is an alkyl group having 18 or more carbon atoms, based on the total amount of the structural units contained in the polymer chain.

The polymer chain may contain only the structural unit represented by the above formula (1), or may further contain a structural unit other than the structural unit represented by the above formula (1) in addition to the structural unit represented by the above formula (1). Moreover, among terminals of the polymer chain, one end is bonded to the core portion, and an atom to which the other end is bonded is not particularly limited. Among these polymer chains, a polymer chain containing only the structural unit represented by the above formula (1), in which one end is bonded to the core portion and the other end is bonded to a hydrogen atom, that is, a polymer chain represented by the following formula (2) is preferable.

[Chemical Formula 7]

(2)

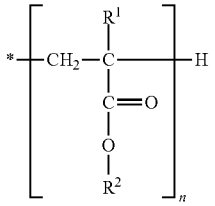

In the formula (2), $R^1$ represents hydrogen or a methyl group, $R^2$ represents a C1 to C36 alkyl group, and n represents an integer selected such that the Mw and the Mw/Mn of the poly(meth)acrylate-based viscosity index improver satisfy the above-described conditions. For example, n is an integer of 40 to 450. Moreover, * represents a bonding hand with the core portion.

The weight-average molecular weight Mw per one arm portion is arbitrarily selected such that the Mw of the poly(meth)acrylate-based viscosity index improver satisfies the above-described condition, and it is preferably 33000 or less, more preferably 30000 or less, and further preferably 27000 or less.

The number average molecular weight Mn per one arm portion is arbitrarily selected such that the Mw/Mn of the poly(meth)acrylate-based viscosity index improver satisfies the above-described condition, and it is preferably 2000 or more, more preferably 4000 or more, and further preferably 8000 or more.

The weight-average molecular weight Mw of the poly (meth)acrylate-based viscosity index improver is less than 100000, and it is preferably 90000 or less, more preferably 80000 or less, and further preferably 60000 or less from the viewpoint of shear stability. The lower limit of Mw is not particularly limited, and the Mw is, for example, 10000 or more.

The weight-average molecular weight Mw of the poly (meth)acrylate-based viscosity index improver is less than 100000, and it is preferably 90000 or less, more preferably 80000 or less, and further preferably 60000 or less from the viewpoint of shear stability. The lower limit of Mw is not particularly limited, and the Mw is, for example, 10000 or more.

The number average molecular weight Mn of the poly (meth)acrylate-based viscosity index improver is arbitrarily selected such that the Mw/Mn satisfies the above-described condition. The Mn is preferably 6000 or more, more preferably 10000 or more, and further preferably 12500 or more from the viewpoint of a fuel saving property. The upper limit of Mn is not particularly limited, and the Mn is, for example, 60000 or less.

It is to be noted that "the weight-average molecular weight Mw", "the number average molecular weight Mn", and "the ratio Mw/Mn of the weight-average molecular weight Mw to the number average molecular weight Mn" in the present invention mean Mw, Mn, and Mw/Mn (converted values with polystyrene (standard sample)) obtained by GPC analysis. Mw/Mn, and Mw and Mn per one arm portion of the poly(meth)acrylate-based viscosity index improver can be measured as follows, for example.

A solution whose sample concentration is 2 mass % is prepared by dilution using tetrahydrofuran as a solvent. The sample solution is analyzed using GPC equipment (Waters Alliance2695). The analysis is carried out at the flow rate of the solvent of 1 ml/min, by using a column whose analyzable molecular weight is 10000 to 256000, and a refractive index as a detector. It is to be noted that the relationship between the column retention time and the molecular weight is determined using a polystyrene standard whose molecular weight is definite and the molecular weight is determined from the obtained retention time based on the calibration curve which is separately made. The molecular weight (Mw and Mn) of the arm can be calculated by dividing the obtained molecular weight (Mw and Mn) by the number of functional groups of an initiator.

The core portion is one derived from a compound having three or more functional groups which react with a carbon-carbon double bond of an acryloyl group. Examples of the compound having three or more functional groups which react with a carbon-carbon double bond of an acryloyl group include 1,1,1-tris(2-bromoisobutyloxymethylene)ethane, pentaerythritoltetrakis(2-bromoisobutyrate), and dipentaerythritolhexakis(2-bromoisobutyrate).

The number of the arm portions in the poly(meth)acrylate-based viscosity index improver corresponds to the number of the above-described functional groups. The number of the arm portions, that is, the number of the above-described functional groups is preferably 2 to 12, more preferably 2 to 8, and further preferably 3 to 6 from the viewpoint of shear stability.

Although the manufacturing method of the poly(meth) acrylate-based viscosity index improver according to the present embodiment is not particularly limited, examples thereof include a method in which a polymerization catalyst is added to a mixed solution containing an alkyl(meth) acrylate, an initiator, and a solvent to polymerize the alkyl (meth)acrylate.

As the alkyl(meth)acrylate, an alkyl(meth)acrylate represented by the following formula (3) can be used.

[Chemical Formula 8]

(3)

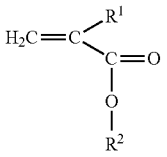

In the formula (3), $R^1$ represents hydrogen or a methyl group, and $R^2$ represents a C1 to C36 alkyl group.

$R^1$ is preferably a methyl group. The number of carbon atoms of the alkyl group represented by $R^2$ is preferably 1 to 30, more preferably 1 to 26, and further preferably 1 to 22.

As the alkyl(meth)acrylate, one of the alkyl(meth)acrylate represented by the above formula (3) can be used alone, or two or more thereof can be mixed to be used, and preferably, two or more thereof are mixed to be used. In the case where two or more thereof are mixed to be used, the content of methyl(meth)acrylate in which $R^2$ is a methyl group is preferably 5 to 50 mass %, more preferably 10 to 45 mass %, and further preferably 20 to 45 mass % based on the total amount of the alkyl(meth)acrylate. Moreover, the content of an alkyl(meth)acrylate in which $R^2$ is an alkyl group having 18 or more carbon atoms is preferably 10 mass % or more, more preferably 20 mass % or more, and further preferably 30 mass % or more based on the total amount of the alkyl(meth)acrylate.

As the initiator, one derived from a compound having three or more functional groups which react with a carbon-carbon double bond of an acryloyl group can be used, and for example, 1,1,1-tris(2-bromoisobutyloxymethylene)ethane, pentaerythritoltetrakis(2-bromoisobutyrate), and dipentaerythritolhexakis(2-bromoisobutyrate) can be used.

As the solvent, for example, highly-refined mineral oils, anisole, and toluene can be used. Examples of a preferred solvent include highly-refined mineral oils.

As the polymerization catalyst, for example, copper(II) bromide, tris(2-pyridylmethyl)amine, azobisisobutyronitrile, tin(II) 2-ethylhexanoate, and tris[2-(dimethylamino) ethyl]amine can be used. Examples of a preferred polymerization catalyst include copper(II) bromide, tris(2-pyridylmethyl)amine, azobisisobutyronitrile, and tin(II) 2-ethylhexanoate. One of these polymerization catalysts may be used alone, or two or more thereof may be mixed to be used.

The reaction temperature when polymerizing the alkyl (meth)acrylate can be arbitrarily selected. Examples of a preferred reaction temperature include 60 to 100° C. By making the reaction temperature be within the above-described range, Mw/Mn of the obtained poly(meth)acrylate-based viscosity index improver becomes easy to be 1.6 or less. For example, when the reaction temperature is 60 to 80° C., Mw/Mn tends to be 1.0 to 1.3, and when the reaction temperature is 80 to 100° C., Mw/Mn tends to be 1.3 to 1.6.

The reaction time can be arbitrarily selected in accordance with the kinds and the amounts used of the alkyl(meth) acrylate, the polymerization reagent, the solvent, and the initiator, which are raw materials, reaction conditions such as a reaction temperature, and desired Mw and Mw/Mn of the poly(meth)acrylate. Examples of preferred reaction time include 8 to 16 hours.

The polymerization of the alkyl(meth)acrylate is preferably carried out in a nitrogen atmosphere.

Fifth Embodiment: Lubricating Oil Additive

A lubricating oil additive according to the fifth embodiment of the present invention contains a poly(meth)acrylate-based viscosity index improver comprising a polymer chain containing a structural unit represented by the above formula (1), wherein the weight-average molecular weight Mw is less than 100000, and the ratio of the weight-average molecular weight Mw to the number average molecular weight Mn, Mw/Mn, is 1.6 or less. It is to be noted that the poly(meth)acrylate-based viscosity index improver in the present embodiment is the same as the viscosity index improver in the above-described fourth embodiment, and an overlapping explanation is omitted here.

The lubricating oil additive may be one composed of only the above-described poly(meth)acrylate-based viscosity index improver, or may be a mixture of the viscosity index improver and other additives (that is, additive composition). In the case where the lubricating oil additive is a mixture of the viscosity index improver and other additives, the mixing ratio thereof is not particularly limited and can be arbitrarily selected depending on the intended use. The other additives are the same as the other additives in the above-described second embodiment, and an overlapping explanation is omitted here.

Furthermore, the lubricating oil additive according to the present embodiment may further contain a solvent. As the solvent, highly-refined mineral oils, solvent-refined base oils, and synthetic oils can be used. Among them, highly-refined mineral oils are preferably used. In the case where the lubricating oil additive contains the solvent, the content of the solvent is preferably 5 to 75 mass %, and more preferably 30 to 60 mass % based on the total amount of the lubricating oil additive.

Sixth Embodiment: Lubricating Oil Composition

A lubricating oil composition according to the sixth embodiment contains a lubricating base oil, and a poly (meth)acrylate-based viscosity index improver comprising a polymer chain containing a structural unit represented by the above formula (1), wherein the weight-average molecular weight Mw is less than 100000, and the ratio of the weight-average molecular weight Mw to the number average molecular weight Mn, Mw/Mn, is 1.6 or less. The lubricating oil composition according to the present embodiment includes an aspect containing a lubricating base oil and the lubricating oil additive according to the above-described fifth embodiment. The poly(meth)acrylate-based viscosity index improver in the present embodiment is the same as the poly(meth)acrylate-based viscosity index improvers in the above-described fourth embodiment and fifth embodiment, and furthermore, other additives and a solvent which can be contained in the lubricating oil composition are the same as the other additives and the solvent in the fifth embodiment, and an overlapping explanation is omitted here.

The lubricating base oil is the same as the lubricating base oil in the above-described third embodiment, and an overlapping explanation is omitted here.

The content of the poly(meth)acrylate-based viscosity index improver according to the fourth embodiment is preferably 0.1 to 20.0 mass %, more preferably 0.5 to 15.0 mass %, and further preferably 1.0 to 10.0 mass % based on the total amount of the lubricating oil composition. When the content is the above-described lower limit or more, a sufficient effect of addition becomes easy to be obtained, and on the other hand, when the content is the above-described upper limit or less, shear stability increases and fuel consumption sustainability is improved.

The kinematic viscosity at 100° C. of the lubricating oil composition is preferably 2.0 to 16.3 $mm^2/s$, more preferably 2.5 to 12.5 $mm^2/s$, and further preferably 3.0 to 10.0 $mm^2/s$. When the kinematic viscosity at 100° C. is the above-described lower limit or more, a lubricating property becomes easy to be ensured, and on the other hand, when the kinematic viscosity at 100° C. is the above-described upper limit or less, a fuel saving property is further improved. It is to be noted that the kinematic viscosity at 100° C. in the present invention means a kinematic viscosity at 100° C. defined by JIS K-2283-1993.

The viscosity index of the lubricating oil composition is preferably 130 to 250, more preferably 140 to 240, and further preferably 160 to 230. When the viscosity index is the above-described lower limit or more, a fuel saving property can be further improved, and moreover, the low-temperature viscosity becomes easy to be lowered while maintaining the HTHS viscosity. On the other hand, when the viscosity index is the above-described upper limit or less, low-temperature fluidity, solubility of additives, and compatibility with a sealing material can be ensured. It is to be noted that the viscosity index in the present invention means a viscosity index defined by JIS K 2283-1993.

The shear rate of the lubricating oil composition is preferably 8% or less, more preferably 5% or less, and further preferably 2% or less. When the shear rate is the above-described upper limit or less, the viscosity of the prescribed oil can be further lowered. It is to be noted that the shear rate in the present invention means a shear rate evaluated with a method by mechanical shear using KRL tapered roller bearing (test method: CEC L45-A-99) so as to simulate shear stability in a gear of a real machine. More specifically, one which is prepared such that a viscosity index improver is 2 mass % in a Group II base oil is continuously operated for 120 hours in conformity with the above-described test method. The decreasing rate of the kinematic viscosity at 100° C. between before and after the test at the time (a value (%) obtained by dividing a difference between the kinematic viscosities before and after the test by the kinematic viscosity before the test) is used as a shear rate.

The viscosity index improver according to the fourth embodiment, the lubricating oil additive according to the fifth embodiment, and the lubricating oil composition according to the sixth embodiment, which are described above, can be used in a wide range of fields such as lubricating oils for an internal combustion engine and drive system lubricating oils, and in particular, are useful in the field of drive system lubricating oils. A driving device in this case may be any of an automatic transmission (AT), a continuously variable transmission (CVT), and a stepped transmission (TM).

EXAMPLES

Hereinafter, the present invention will be described in further detail with reference to Examples, but the present invention is not limited to the following Examples.

Example 1-1

A poly(meth)acrylate-based viscosity index improver was synthesized in the following condition (designated as "Synthesis Condition 1-1").

18 g of methyl methacrylate (compound in which both $R^1$ and $R^2$ in the formula (3) are methyl groups, and hereinafter, designated as "C1-MA"), 42 g of stearyl methacrylate (compound in which $R^1$ and $R^2$ in the formula (3) are a methyl group and a stearyl group (straight-chain alkyl group having 18 carbon atoms), respectively, and hereinafter, designated as "C18-MA"), 0.061 g of 1,1,1-tris(2-bromoisobutyloxymethyl)ethane (hereinafter, designated as "X") that is a three-functional initiator, as an initiator, and 117 g of a highly-refined mineral oil (kinematic viscosity at 100° C.: 4.2 $mm^2/s$) as a solvent were charged into a 300 ml five-neck separable flask fitted with an anchor-type metal stirring blade (with vacuum seal), a Dimroth condenser, a three-way cock for introducing nitrogen, and a sample inlet, and a homogeneous solution was obtained under stirring. The solution was cooled to 0° C. on an ice bath, and vacuum deaeration/nitrogen purge of a reaction system was carried out 5 times using a diaphragm pump. Furthermore, from the sample inlet, as a polymerization catalyst, a complex solution in which 0.004 g of copper(II) bromide and 0.005 g of tris(2-pyridylmethyl)amine are dissolved in 2.0 g of anisole, and 0.056 g of azobisisobutyronitrile (AIBN) were charged under nitrogen flow, and then, polymerization was carried out by stirring for 12 hours at the solution temperature of 90° C. under a nitrogen atmosphere to obtain a solution containing a poly(meth)acrylate-based viscosity index improver comprising three arm portions.

For the obtained poly(meth)acrylate-based viscosity index improver, the weight-average molecular weight Mw and the number average molecular weight Mn were measured by GPC analysis. As a result, the weight-average molecular weight Mw was 229000, the number average molecular weight Mn was 158000, and the Mw/Mn was 1.45. The procedure of the GPC analysis is as follows.

A solution whose sample concentration is 2 mass % was prepared by dilution using tetrahydrofuran as a solvent. The sample solution was analyzed using GPC equipment (Waters Alliance2695). The analysis was carried out at the flow rate of the solvent of 1 ml/min, by using a column whose analyzable molecular weight is 10000 to 256000, and a refractive index as a detector. It is to be noted that the relationship between the column retention time and the molecular weight was determined using a polystyrene standard whose molecular weight is definite and the molecular weight was determined from the obtained retention time based on the calibration curve which was separately made.

Example 1-7

A poly(meth)acrylate-based viscosity index improver was synthesized in the following condition (designated as "Synthesis Condition 1-2").

18 g of methyl methacrylate (C1-MA), 42 g of stearyl methacrylate (C18-MA), 0.061 g of 1,1,1-tris(2-bromoisobutyloxymethyl)ethane (X) that is a three-functional initiator, as an initiator, and 117 g of a highly-refined mineral oil (kinematic viscosity at 100° C.: 4.2 $mm^2/s$) as a solvent were charged into a 300 ml five-neck separable flask fitted with an anchor-type metal stirring blade (with vacuum seal), a Dimroth condenser, a three-way cock for introducing nitrogen, and a sample inlet, and a homogeneous solution was obtained under stirring. The solution was cooled to 0° C. on an ice bath, and vacuum deaeration/nitrogen purge of a reaction system was carried out 5 times using a diaphragm pump. Furthermore, from the sample inlet, as a polymerization catalyst, a complex solution in which 0.004 g of copper(II) bromide and 0.005 g of tris(2-pyridylmethyl) amine are dissolved in 2.0 g of anisole, and a solution in which 0.17 g of tin(II) 2-ethylhexanoate is dissolved in 3 g of a highly-refined mineral oil (kinematic viscosity at 100° C.: 4.2 $mm^2/s$) were charged under nitrogen flow, and then, polymerization was carried out by stirring for 12 hours at the solution temperature of 70° C. under a nitrogen atmosphere to obtain a solution containing a poly(meth)acrylate-based viscosity index improver comprising three arm portions.

For the obtained poly(meth)acrylate-based viscosity index improver, GPC analysis was carried out in the same manner as Example 1-1, and as a result, the weight-average molecular weight Mw was 229000, the number average molecular weight Mn was 183200, and the Mw/Mn was 1.25.

Comparative Example 1-3

A poly(meth)acrylate-based viscosity index improver was synthesized in the following condition (designated as "Synthesis Condition 1-3").

18 g of methyl methacrylate (C1-MA), 42 g of stearyl methacrylate (C18-MA), 0.06 g of cumyl dithiobenzoic acid (CDTBA), and 60 g of a highly-refined mineral oil (kinematic viscosity at 100° C.: 4.2 $mm^2/s$) as a solvent were charged into a 300 ml five-neck separable flask fitted with an anchor-type metal stirring blade (with vacuum seal), a Dimroth condenser, a three-way cock for introducing nitrogen, and a sample inlet, and a homogeneous solution was obtained under stirring. The solution was cooled to 0° C. on an ice bath, and vacuum deaeration/nitrogen purge of a reaction system was carried out 5 times using a diaphragm pump. Furthermore, from the sample inlet, as an initiator, 0.015 g of azobisisobutyronitrile (AIBN) was charged under nitrogen flow, and then, polymerization was carried out for 12 hours at the solution temperature of 90° C. under a nitrogen atmosphere to obtain a solution containing a poly (meth)acrylate-based viscosity index improver.

For the obtained poly(meth)acrylate-based viscosity index improver, GPC analysis was carried out in the same manner as Example 1-1, and as a result, the weight-average molecular weight Mw was 220000, the number average molecular weight Mn was 133000, and the Mw/Mn was 1.65.

Comparative Example 1-4

A poly(meth)acrylate-based viscosity index improver was synthesized in the following condition (designated as "Synthesis Condition 1-4").

30 g of a highly-refined mineral oil as a solvent was charged into a 300 ml four-neck reaction flask fitted with a stirring blade (with vacuum seal), a Dimroth condenser, a three-way cock for introducing nitrogen, and a dropping funnel for introducing a sample, and it was stirred for 1 hour in an oil bath at 85° C. while carrying out nitrogen purge. A raw material in which 12 g of methyl methacrylate (C1-MA) and 42 g of stearyl methacrylate (C18-MA) as raw material monomers, and 0.24 g of azobisisobutyronitrile (AIBN) as an initiator are mixed was charged into the dropping funnel for introducing a sample, and the raw material was dropped in the reaction flask for 120 minutes. After that, polymerization was carried out for 8 hours at 85° C. under nitrogen flow while maintaining stirring to obtain a solution containing a poly(meth)acrylate-based viscosity index improver. After that, unreacted monomers were removed from the above-described solution by carrying out vacuum distillation for 3 hours at 130° C. and 1 mmHg.

For the obtained poly(meth)acrylate-based viscosity index improver, GPC analysis was carried out in the same manner as Example 1-1, and as a result, the weight-average molecular weight Mw was 285000, the number average molecular weight Mn was 125000, and the Mw/Mn was 2.28.

Examples 1-2 to 1-6, 1-8 to 1-24, Comparative Examples 1-1 to 1-3, 1-5

A poly(meth)acrylate-based viscosity index improver was synthesized in the same manner as any of the above-described Synthesis Conditions 1-1 to 1-4 other than changing the amount of the raw material blended as shown in Tables 1, 3, 5, 7, and 9. It is to be noted that, in Comparative Example 1-5, the polymerization temperature was changed to 85° C. in Synthesis Condition 1-4. Moreover, in Tables, Y represents pentaerythritoltetrakis(2-bromoisobutyrate) that is a four-functional initiator and Z represents dipentaerythritolhexakis(2-bromoisobutyrate) that is a six-functional initiator. Furthermore, 2EH-MA represents a compound in which $R^1$ and $R^2$ in the formula (1) are a methyl group and a 2-ethylhexyl group (alkyl group having 8 total carbon atoms with one branch having 2 carbon atoms), respectively. Mw, Mn, and Mw/Mn of the obtained poly (meth)acrylate-based viscosity index improver are shown in Tables 2, 4, 6, 8, and 10.

<Preparation of Lubricating Oil Composition>

The poly(meth)acrylate-based viscosity index improver obtained in each of Examples 1-1 to 1-24 and Comparative Examples 1-1 to 1-6, performance additives including a metallic (calcium sulfonate) cleaner, an ashless dispersant (succinimide), a friction modifier (glycerin monooleate), and a wear inhibitor (zinc dithiophosphate), and a highly-refined mineral oil (Group III base oil, kinematic viscosity at 100° C.: 4.2 $mm^2/s$, VI: 125) were blended at a ratio shown in Tables 2, 4, 6, 8, and 10 to prepare a lubricating oil composition.

<Evaluation of Lubricating Oil Composition>

For each lubricating oil composition of Examples 1-1 to 1-24 and Comparative Examples 1-1 to 1-6, the kinematic viscosity at 100° C., the viscosity index, and the HTHS viscosities at 100° C. and 150° C. were respectively measured by methods in conformity with the following. The results are shown in Tables 2, 4, 6, 8, and 10.

kinematic viscosity: JIS K-2283-1993 viscosity index: JIS K-2283-1993

HTHS viscosity: ASTM D-4683

Moreover, for each lubricating oil composition of Examples 1-1 to 1-24 and Comparative Examples 1-1 to 1-6, the viscosity decreasing rate was measured as follows. That is, a decreasing rate of a thickening property due to the viscosity index improver when performing evaluation in a condition where only a sample volume is increased was measured in conformity with JASO M347-95 (Automatic transmission fluids-Test method for shear stability). More specifically, Permanent Shear Stability Index PSSI of a polymer, which is calculated based on a measured kinematic viscosity obtained by performing a shear test in conditions where the amplitude was 28 μm, the frequency was 10 kHz, the exposure time was 10 minutes, and the sample volume was 50 mL after carrying out power conditioning with a standard oil A defined in a test method of ASTM, was calculated. The results are shown in Tables 2, 4, 6, 8, and 10.

TABLE 1

| | Example 1-1 | Example 1-2 | Example 1-3 | Example 1-4 | Example 1-5 | Example 1-6 |
|---|---|---|---|---|---|---|
| Initiator Amount Blended (g) | X | Y | Z | X | Y | Z |
| C1-MA | 18 | 18 | 18 | 18 | 18 | 18 |
| C18-MA | 42 | 42 | 42 | 42 | 42 | 42 |
| 2EH-MA | — | — | — | — | — | — |
| C22-MA | — | — | — | — | — | — |
| X, Y, Z | 0.061 | 0.062 | 0.060 | 0.120 | 0.118 | 0.122 |
| CDTBA | — | — | — | — | — | — |
| AIBN | — | — | — | — | — | — |

TABLE 1-continued

| | Example 1-1 | Example 1-2 | Example 1-3 | Example 1-4 | Example 1-5 | Example 1-6 |
|---|---|---|---|---|---|---|
| Synthesis Condition | 1-1 | 1-1 | 1-1 | 1-1 | 1-1 | 1-1 |
| Yield (%) | 98.5 | 98.3 | 98.8 | 96.9 | 97.2 | 95.9 |

TABLE 2

| | Example 1-1 | Example 1-2 | Example 1-3 | Example 1-4 | Example 1-5 | Example 1-6 |
|---|---|---|---|---|---|---|
| Initiator | X | Y | Z | X | Y | Z |
| Alkyl(meth)acrylate Blending Ratio (mass %) | | | | | | |
| C1-MA | 30 | 30 | 30 | 30 | 30 | 30 |
| C18-MA | 70 | 70 | 70 | 70 | 70 | 70 |
| 2EH-MA | — | — | — | — | — | — |
| C22-MA | — | — | — | — | — | — |
| Mw | 229,000 | 218,000 | 220,000 | 122,000 | 108,000 | 126,000 |
| Mn | 158,000 | 147,000 | 155,000 | 85,000 | 71,500 | 85,000 |
| Mw/Mn | 1.45 | 1.48 | 1.42 | 1.43 | 1.51 | 1.49 |
| Mw per One Arm Portion | 76,000 | 54,500 | 36,700 | 41,000 | 27,000 | 21,000 |
| Blending Proportion in Lubricating oil composition (mass %) | | | | | | |
| Base Oil | Balance | Balance | Balance | Balance | Balance | Balance |
| Performance Additive | 9.5 | 9.5 | 9.5 | 9.5 | 9.5 | 9.5 |
| Viscosity Index Improver | 2.8 | 2.8 | 2.8 | 3.7 | 3.6 | 3.5 |
| Kinematic Viscosity ($mm^2/s$)/100° C. | 7.35 | 7.41 | 7.33 | 7.29 | 7.51 | 7.44 |
| Viscosity Index | 190 | 192 | 189 | 192 | 193 | 192 |
| HTHS Viscosity (mPa · s) | | | | | | |
| 150° C. | 2.60 | 2.60 | 2.60 | 2.60 | 2.60 | 2.60 |
| 100° C. | 4.91 | 4.90 | 4.92 | 4.93 | 4.95 | 4.88 |
| Viscosity Decreasing Rate (%) | 3.2 | 2.5 | 1.3 | 3.7 | 2.4 | 1.8 |

TABLE 3

| | Example 1-7 | Example 1-8 | Example 1-9 | Example 1-10 | Example 1-11 | Example 1-12 |
|---|---|---|---|---|---|---|
| Initiator | X | Y | Z | X | Y | Z |
| Amount Blended (g) | | | | | | |
| C1-MA | 18 | 18 | 18 | 18 | 18 | 18 |
| C18-MA | 42 | 42 | 42 | 42 | 42 | 42 |
| 2EH-MA | — | — | — | — | — | — |
| C22-MA | — | — | — | — | — | — |
| X, Y, Z | 0.061 | 0.062 | 0.060 | 0.120 | 0.118 | 0.122 |
| CDTBA | — | — | — | — | — | — |

TABLE 3-continued

| | Example 1-7 | Example 1-8 | Example 1-9 | Example 1-10 | Example 1-11 | Example 1-12 |
|---|---|---|---|---|---|---|
| AIBN | — | — | — | — | — | — |
| Synthesis Condition | 1-2 | 1-2 | 1-2 | 1-2 | 1-2 | 1-2 |
| Yield (%) | 98.5 | 98.3 | 98.8 | 96.9 | 97.2 | 95.9 |

TABLE 4

| | Example 1-7 | Example 1-8 | Example 1-9 | Example 1-10 | Example 1-11 | Example 1-12 |
|---|---|---|---|---|---|---|
| Initiator | X | Y | Z | X | Y | Z |
| Alkyl(meth)acrylate Blending Ratio (mass %) | | | | | | |
| C1-MA | 30 | 30 | 30 | 30 | 30 | 30 |
| C18-MA | 70 | 70 | 70 | 70 | 70 | 70 |
| 2EH-MA | — | — | — | — | — | — |
| C22-MA | — | — | — | — | — | — |
| Mw | 229,000 | 218,000 | 220,000 | 112,000 | 108,000 | 121,000 |

TABLE 4-continued

| | Example 1-7 | Example 1-8 | Example 1-9 | Example 1-10 | Example 1-11 | Example 1-12 |
|---|---|---|---|---|---|---|
| Mn | 183,200 | 185,000 | 196,000 | 100,800 | 97,000 | 111,000 |
| Mw/Mn | 1.25 | 1.18 | 1.12 | 1.03 | 1.11 | 1.09 |
| Mw per One Arm Portion | 76,000 | 54,500 | 36,700 | 37,000 | 27,000 | 20,200 |
| Blending Proportion in Lubricating oil composition (mass %) | | | | | | |
| Base Oil | Balance | Balance | Balance | Balance | Balance | Balance |
| Performance Additive | 9.5 | 9.5 | 9.5 | 9.5 | 9.5 | 9.5 |
| Viscosity Index Improver | 2.8 | 2.9 | 2.7 | 3.5 | 3.6 | 3.9 |
| Kinematic Viscosity ($mm^2/s$)/100° C. | 7.45 | 7.43 | 7.39 | 7.49 | 7.45 | 7.49 |
| Viscosity Index | 192 | 195 | 190 | 195 | 195 | 193 |
| HTHS Viscosity (mPa · s) | | | | | | |
| 150° C. | 2.60 | 2.60 | 2.60 | 2.60 | 2.60 | 2.60 |
| 100° C. | 4.94 | 4.91 | 4.90 | 4.98 | 4.94 | 4.98 |
| Viscosity Decreasing Rate (%) | 3.3 | 2.7 | 2.3 | 4.7 | 2.4 | 1.9 |

TABLE 5

| | Example 1-13 | Example 1-14 | Example 1-15 | Example 1-16 | Example 1-17 | Example 1-18 |
|---|---|---|---|---|---|---|
| Initiator | X | Y | Z | X | Y | Z |
| Amount Blended (g) | | | | | | |
| C1-MA | 12 | 12 | 12 | 27 | 27 | 27 |
| C18-MA | 48 | 48 | 48 | 33 | 33 | 33 |
| 2EH-MA | — | — | — | — | — | — |
| C22-MA | — | — | — | — | — | — |

TABLE 5-continued

| | Example 1-13 | Example 1-14 | Example 1-15 | Example 1-16 | Example 1-17 | Example 1-18 |
|---|---|---|---|---|---|---|
| X, Y, Z | 0.061 | 0.062 | 0.060 | 0.061 | 0.062 | 0.060 |
| CDTBA | — | — | — | — | — | — |
| AIBN | — | — | — | — | — | — |
| Synthesis Condition | 1-2 | 1-2 | 1-2 | 1-2 | 1-2 | 1-2 |
| Yield (%) | 98.5 | 98.3 | 98.8 | 96.9 | 97.2 | 95.9 |

TABLE 6

| | Example 1-13 | Example 1-14 | Example 1-15 | Example 1-16 | Example 1-17 | Example 1-18 |
|---|---|---|---|---|---|---|
| Initiator | X | Y | Z | X | Y | Z |
| Alkyl(meth)acrylate Blending Ratio (mass %) | | | | | | |
| C1-MA | 20 | 20 | 20 | 45 | 45 | 45 |
| C18-MA | 80 | 80 | 80 | 55 | 55 | 55 |
| 2EH-MA | — | — | — | — | — | — |
| C22-MA | — | — | — | — | — | — |
| Mw | 229,000 | 218,000 | 220,000 | 222,000 | 218,000 | 236,000 |
| Mn | 183,200 | 185,000 | 196,000 | 215,000 | 196,000 | 216,500 |
| Mw/Mn | 1.25 | 1.18 | 1.12 | 1.03 | 1.11 | 1.09 |
| Mw per One Arm Portion | 76,000 | 54,500 | 36,700 | 74,000 | 54,500 | 39,300 |
| Blending Proportion in Lubricating oil composition (mass %) | | | | | | |
| Base Oil | Balance | Balance | Balance | Balance | Balance | Balance |
| Performance Additive | 9.5 | 9.5 | 9.5 | 9.5 | 9.5 | 9.5 |
| Viscosity Index Improver | 2.9 | 2.8 | 2.8 | 2.7 | 2.6 | 2.5 |
| Kinematic Viscosity ($mm^2/s$)/100° C. | 7.15 | 7.11 | 7.13 | 7.29 | 7.51 | 7.44 |
| Viscosity Index | 198 | 197 | 199 | 192 | 197 | 195 |
| HTHS Viscosity (mPa · s) | | | | | | |
| 150° C. | 2.60 | 2.60 | 2.60 | 2.60 | 2.60 | 2.60 |
| 100° C. | 4.99 | 4.98 | 4.98 | 4.78 | 4.79 | 4.78 |
| Viscosity Decreasing Rate (%) | 4.2 | 3.3 | 2.8 | 3.8 | 2.7 | 1.5 |

TABLE 7

| | Example 1-19 | Example 1-20 | Example 1-21 | Example 1-22 | Example 1-23 | Example 1-24 |
|---|---|---|---|---|---|---|
| Initiator Amount Blended (g) | X | Y | Z | X | Y | Z |
| C1-MA | 24 | 24 | 24 | 24 | 24 | 24 |
| C18-MA | 18 | 18 | 18 | 18 | 18 | 18 |
| 2EH-MA | 9 | 9 | 9 | 9 | 9 | 9 |
| C22-MA | 9 | 9 | 9 | 9 | 9 | 9 |
| X, Y, Z | 0.061 | 0.062 | 0.060 | 0.120 | 0.118 | 0.122 |
| CDTBA | — | — | — | — | — | — |
| AIBN | — | — | — | — | — | — |
| Synthesis Condition | 1-2 | 1-2 | 1-2 | 1-2 | 1-2 | 1-2 |
| Yield (%) | 98.5 | 98.3 | 98.8 | 96.9 | 97.2 | 95.9 |

TABLE 9

| | Comp. Ex. 1-1 | Comp. Ex. 1-2 | Comp. Ex. 1-3 | Comp. Ex. 1-4 | Comp. Ex. 1-5 |
|---|---|---|---|---|---|
| Initiator Amount Blended (g) | X | Z | CDTBA | AIBN | AIBN |
| C1-MA | 24 | 24 | 24 | 24 | 24 |
| C18-MA | 36 | 36 | 36 | 36 | 36 |
| 2EH-MA | — | — | — | — | — |
| C22-MA | — | — | — | — | — |
| X, Y, Z | 0.130 | 0.130 | — | — | — |
| CDTBA | — | — | 0.033 | — | — |
| AIBN | — | — | 0.005 | 0.24 | 0.24 |
| Synthesis Condition | 1-1 | 1-2 | 1-3 | 1-4 | 1-4 |
| Yield (%) | 95.2 | 95.6 | 94.8 | 94.8 | 95.2 |

TABLE 8

| | Example 1-19 | Example 1-20 | Example 1-21 | Example 1-22 | Example 1-23 | Example 1-24 |
|---|---|---|---|---|---|---|
| Initiator | X | Y | Z | X | Y | Z |
| Alkyl(meth)acrylate Blending Ratio (mass %) | | | | | | |
| C1-MA | 40 | 40 | 40 | 40 | 40 | 40 |
| C18-MA | 30 | 30 | 30 | 30 | 30 | 30 |
| 2EH-MA | 15 | 15 | 15 | 15 | 15 | 15 |
| C22-MA | 15 | 15 | 15 | 15 | 15 | 15 |
| Mw | 239,000 | 228,000 | 218,000 | 233,000 | 227,000 | 231,000 |
| Mn | 188,000 | 178,000 | 213,000 | 215,000 | 224,000 | 208,000 |
| Mw/Mn | 1.27 | 1.28 | 1.02 | 1.08 | 1.01 | 1.11 |
| Mw per One Arm Portion | 79,600 | 57,000 | 36,000 | 77,000 | 57,000 | 38,500 |
| Blending Proportion in Lubricating oil composition (mass %) | | | | | | |
| Base Oil | Balance | Balance | Balance | Balance | Balance | Balance |
| Performance Additive | 9.5 | 9.5 | 9.5 | 9.5 | 9.5 | 9.5 |
| Viscosity Index Improver | 2.8 | 2.8 | 2.8 | 2.1 | 2.6 | 2.5 |
| Kinematic Viscosity ($mm^2/s$)/100° C. | 7.45 | 7.43 | 7.36 | 7.31 | 7.41 | 7.38 |
| Viscosity Index | 195 | 195 | 192 | 193 | 198 | 196 |
| HTHS Viscosity (mPa · s) | | | | | | |
| 150° C | 2.60 | 2.60 | 2.60 | 2.60 | 2.60 | 2.60 |
| 100° C | 4.91 | 4.88 | 4.85 | 4.85 | 4.86 | 4.85 |
| Viscosity Decreasing Rate (%) | 3.2 | 3.0 | 1.3 | 1.4 | 1.2 | 1.1 |

TABLE 10

| | Comp. Ex. 1-1 | Comp. Ex. 1-2 | Comp. Ex. 1-3 | Comp. Ex. 1-4 | Comp. Ex. 1-5 |
|---|---|---|---|---|---|
| Initiator | X | Z | CDTBA | AIBN | AIBN |
| Alkyl(meth)acrylate Blending Ratio (mass %) | | | | | |
| C1-MA | 40 | 40 | 40 | 40 | 40 |
| C18-MA | 60 | 60 | 60 | 60 | 60 |
| 2EH-MA | — | — | — | — | — |
| C22-MA | — | — | — | — | — |
| Mw | 98,000 | 97,000 | 220,000 | 285,000 | 107,000 |
| Mn | 67,000 | 87,000 | 133,000 | 125,000 | 64,000 |
| Mw/Mn | 1.45 | 1.11 | 1.65 | 2.28 | 1.68 |
| Mw per One Arm Portion | 32,600 | 16,000 | — | — | — |
| Blending Proportion in Lubricating oil composition (mass %) | | | | | |
| Base Oil | Balance | Balance | Balance | Balance | Balance |
| Performance Additive | 9.5 | 9.5 | 9.5 | 9.5 | 9.5 |
| Viscosity Index Improver | 2.6 | 2.7 | 2.2 | 2.2 | 3.2 |
| Kinematic Viscosity ($mm^2/s$)/100° C. | 8.03 | 8.15 | 8.15 | 8.01 | 8.22 |
| Viscosity Index | 195 | 194 | 194 | 210 | 205 |
| HTHS Viscosity (mPa · s) | | | | | |
| 150° C. | 2.60 | 2.60 | 2.60 | 2.60 | 2.60 |
| 100° C. | 5.32 | 5.28 | 5.28 | 4.88 | 5.10 |
| Viscosity Decreasing Rate (%) | 3.3 | 2.8 | 2.8 | 15.0 | 13.8 |

Example 2-1

A poly(meth)acrylate-based viscosity index improver was synthesized in the following condition (designated as "Synthesis Condition 2-1").

18 g of methyl methacrylate (compound in which both $R^1$ and $R^2$ in the formula (3) are methyl groups, and hereinafter, designated as "C1-MA"), 42 g of stearyl methacrylate (compound in which $R^1$ and $R^2$ in the formula (3) are a methyl group and a stearyl group (straight-chain alkyl group having 18 carbon atoms), respectively, and hereinafter, designated as "C18-MA"), 0.18 g of 1,1,1-tris(2-bromoisobutyloxymethyl)ethane (hereinafter, designated as "X") that is a three-functional initiator, as an initiator, and 117 g of a highly-refined mineral oil (kinematic viscosity at 100° C.: 4.2 $min^2/s$) as a solvent were charged into a 300 ml five-neck separable flask fitted with an anchor-type metal stirring blade (with vacuum seal), a Dimroth condenser, a three-way cock for introducing nitrogen, and a sample inlet, and a homogeneous solution was obtained under stirring. The solution was cooled to 0° C. on an ice bath, and vacuum deaeration/nitrogen purge of a reaction system was carried out 5 times using a diaphragm pump. Furthermore, from the sample inlet, as a polymerization catalyst, a complex solution in which 0.004 g of copper(II) bromide and 0.005 g of tris(2-pyridylmethyl)amine are dissolved in 2.0 g of anisole, and 0.056 g of azobisisobutyronitrile (AIBN) were charged under nitrogen flow, and then, polymerization was carried out by stirring for 12 hours at the solution temperature of 70° C. under a nitrogen atmosphere to obtain a solution containing a poly(meth)acrylate-based viscosity index improver comprising three arm portions.

For the obtained poly(meth)acrylate-based viscosity index improver, the weight-average molecular weight Mw and the number average molecular weight Mn were measured by GPC analysis. As a result, the weight-average molecular weight Mw was 97000, the number average molecular weight Mn was 64000, and Mw/Mn was 1.51. The procedure of the GPC analysis is as follows.

A solution whose sample concentration is 2 mass % was prepared by dilution using tetrahydrofuran as a solvent. The sample solution was analyzed using GPC equipment (Waters Alliance2695). The analysis was carried out at the flow rate of the solvent of 1 ml/min, by using a column whose analyzable molecular weight is 10000 to 256000, and a refractive index as a detector. It is to be noted that the relationship between the column retention time and the molecular weight was determined using a polystyrene standard whose molecular weight is definite and the molecular weight was determined from the obtained retention time based on the calibration curve which was separately made.

Example 2-7

A poly(meth)acrylate-based viscosity index improver was synthesized in the following condition (designated as "Synthesis Condition 2-2").

18 g of methyl methacrylate (C1-MA), 42 g of stearyl methacrylate (C18-MA), 0.14 g of 1,1,1-tris(2-bromoisobutyloxymethyl)ethane (X) that is a three-functional initiator, as an initiator, and 117 g of a highly-refined mineral oil (kinematic viscosity at 100° C.: 4.2 $mm^2/s$) as a solvent were charged into a 300 ml five-neck separable flask fitted with an anchor-type metal stirring blade (with vacuum seal), a Dimroth condenser, a three-way cock for introducing nitrogen, and a sample inlet, and a homogeneous solution was obtained under stirring. The solution was cooled to 0° C. on an ice bath, and vacuum deaeration/nitrogen purge of a reaction system was carried out 5 times using a diaphragm pump. Furthermore, from the sample inlet, as a polymerization catalyst, a complex solution in which 0.004 g of copper(II) bromide and 0.005 g of tris(2-pyridylmethyl) amine are dissolved in 2.0 g of anisole, and a solution in which 0.17 g of tin(II) 2-ethylhexanoate is dissolved in 3 g of a highly-refined mineral oil (kinematic viscosity at 100°

C.: 4.2 $mm^2/s$) were charged under nitrogen flow, and then, polymerization was carried out by stirring for 12 hours at the solution temperature of 70° C. under a nitrogen atmosphere to obtain a solution containing a poly(meth)acrylate-based viscosity index improver comprising three arm portions.

For the obtained poly(meth)acrylate-based viscosity index improver, GPC analysis was carried out in the same manner as Example 2-1, and as a result, the weight-average molecular weight Mw was 98000, the number average molecular weight Mn was 80300, and Mw/Mn was 1.22.

Comparative Example 2-3

A poly(meth)acrylate-based viscosity index improver was synthesized in the following condition (designated as "Synthesis Condition 2-3").

18 g of methyl methacrylate (C1-MA), 42 g of stearyl methacrylate (C18-MA), 0.65 g of cumyl dithiobenzoic acid (CDTBA), and 60 g of a highly-refined mineral oil (kinematic viscosity at 100° C.: 4.2 $mm^2/s$) as a solvent were charged into a 300 ml five-neck separable flask fitted with an anchor-type metal stirring blade (with vacuum seal), a Dimroth condenser, a three-way cock for introducing nitrogen, and a sample inlet, and a homogeneous solution was obtained under stirring. The solution was cooled to 0° C. on an ice bath, and vacuum deaeration/nitrogen purge of a reaction system was carried out 5 times using a diaphragm pump. Furthermore, from the sample inlet, as an initiator, 0.06 g of azobisisobutyronitrile (AIBN) was charged under nitrogen flow, and then, polymerization was carried out for 12 hours at the solution temperature of 90° C. under a nitrogen atmosphere to obtain a solution containing a poly (meth)acrylate-based viscosity index improver.

For the obtained poly(meth)acrylate-based viscosity index improver, GPC analysis was carried out in the same manner as Example 2-1, and as a result, the weight-average molecular weight Mw was 90000, the number average molecular weight Mn was 54000, and Mw/Mn was 1.71.

Comparative Example 2-5

A poly(meth)acrylate-based viscosity index improver was synthesized in the following condition (designated as "Synthesis Condition 2-4").

30 g of a highly-refined mineral oil as a solvent was charged into a 300 ml four-neck reaction flask fitted with a stirring blade (with vacuum seal), a Dimroth condenser, a three-way cock for introducing nitrogen, and a dropping funnel for introducing a sample, and it was stirred for 1 hour in an oil bath at 85° C. while carrying out nitrogen purge. A raw material in which 12 g of methyl methacrylate (C1-MA) and 42 g of stearyl methacrylate (C18-MA) as raw material monomers, and 0.24 g of azobisisobutyronitrile (AIBN) as an initiator are mixed was charged into the dropping funnel for introducing a sample, and the raw material was dropped in the reaction flask for 120 minutes. After that, polymerization was carried out for 8 hours at 85° C. under nitrogen flow while maintaining stirring to obtain a solution containing a poly(meth)acrylate-based viscosity index improver. After that, unreacted monomers were removed from the above-described solution by carrying out vacuum distillation for 3 hours at 130° C. and 1 mmHg.

For the obtained poly(meth)acrylate-based viscosity index improver, GPC analysis was carried out in the same manner as Example 2-1, and as a result, the weight-average molecular weight Mw was 97000, the number average molecular weight Mn was 42500, and Mw/Mn was 2.28.

Examples 2-2 to 2-6, 2-8 to 2-28, Comparative Examples 2-1 to 2-2, 2-4, 2-6

A poly(meth)acrylate-based viscosity index improver was synthesized in the same manner as any of the above-described Synthesis Conditions 2-1 to 2-4 other than changing the amount of the raw material blended as shown in Tables 11, 13, 15, 17, 19, and 21. It is to be noted that, in Tables, Y represents pentaerythritoltetrakis(2-bromoisobutyrate) that is a four-functional initiator and Z represents dipentaerythritolhexakis(2-bromoisobutyrate) that is a six-functional initiator. Moreover, 2EH-MA represents a compound in which $R^1$ and $R^2$ in the formula (1) are a methyl group and a 2-ethylhexyl group (alkyl group having 8 total carbon atoms with one branch having 2 carbon atoms), respectively, and C12-MA represents a compound in which $R^1$ and $R^2$ in the formula (3) are a methyl group and a dodecyl group (straight-chain alkyl group having 12 carbon atoms), respectively. Mw, Mn, and Mw/Mn of the obtained poly(meth)acrylate-based viscosity index improver are shown in Tables 12, 14, 16, 18, 20, and 22.

<Preparation of Lubricating Oil Composition>

The poly(meth)acrylate-based viscosity index improver obtained in each of Examples 2-1 to 2-28 and Comparative Examples 2-1 to 2-6, performance additives including a metallic (calcium sulfonate whose TBN is 300 mgKOH/g) cleaner, an ashless dispersant (succinimide), a friction modifier (oleylamine), a wear inhibitor (phosphoric acid), an antioxidant (diphenylamine), a metal deactivator (thiadiazole), and a sulfur additive (sulfide ester), and a highly-refined mineral oil (Group II base oil, kinematic viscosity at 100° C.: 3.3 $mm^2/s$, VI: 110) were blended at a ratio shown in Tables 12, 14, 16, 18, 20, and 22 to prepare a lubricating oil composition.

<Evaluation of Lubricating Oil Composition>

For each lubricating oil composition of Examples 2-1 to 2-28 and Comparative Examples 2-1 to 2-6, the kinematic viscosity at 100° C., the viscosity index, and the shear stability were respectively measured by methods in conformity with the following. The results are shown in Tables 12, 14, 16, 18, 20, and 22.

kinematic viscosity: JIS K-2283-1993 viscosity index: JIS K 2283-1993

Moreover, the friction property of each lubricating oil composition of Examples 2-1 to 2-28 and Comparative Examples 2-1 to 2-6 was evaluated by a friction coefficient in a condition of constant load using a two cylinder rolling sliding friction tester. Specifically, a friction coefficient was averaged for 10 minutes from the start of the test in conditions where the test temperature is 80° C., the load is 142 N, the surface pressure is 0.48 GPa, the peripheral speed is 1.0 m/s, and the sliding ratio is 5.1%. The results are shown in Tables 12, 14, 16, 18, 20, and 22.

Furthermore, the shear stability when using each viscosity index improver of Examples 2-1 to 2-28 and Comparative Examples 2-1 to 2-6 was evaluated with a method by mechanical shear using KRL tapered roller bearing (test method: CEC L45-A-99) so as to simulate shear stability in a gear of a real machine. More specifically, one which was prepared such that each viscosity index improver is 2 mass % in a Group II base oil was continuously operated for 120 hours in conformity with the above-described test method. The decreasing rate of the kinematic viscosity at 100° C. between before and after the test at the time (a value (%)

obtained by dividing a difference between the kinematic viscosities before and after the test by the kinematic viscosity before the test) was evaluated as a shear rate. The results are shown in Tables 12, 14, 16, 18, 20, and 22.

TABLE 11

| | Example 2-1 | Example 2-2 | Example 2-3 | Example 2-4 | Example 2-5 | Example 2-6 |
|---|---|---|---|---|---|---|
| Initiator Amount Blended (g) | X | Y | Z | X | Y | Z |
| C1-MA | 18 | 18 | 18 | 18 | 18 | 18 |
| C18-MA | 42 | 42 | 42 | 42 | 42 | 42 |
| 2EH-MA | — | — | — | — | — | — |
| C12-MA | — | — | — | — | — | — |
| C22-MA | — | — | — | — | — | — |
| X, Y, Z | 0.18 | 0.24 | 0.33 | 0.72 | 1.01 | 1.42 |
| CDTBA | — | — | — | — | — | — |
| AIBN | — | — | — | — | — | — |
| Synthesis Condition | 2-1 | 2-1 | 2-1 | 2-1 | 2-1 | 2-1 |
| Yield (%) | 98.3 | 98.8 | 98.5 | 96.4 | 97.9 | 95.1 |

TABLE 13

| | Example 2-7 | Example 2-8 | Example 2-9 | Example 2-10 | Example 2-11 | Example 2-12 |
|---|---|---|---|---|---|---|
| Initiator Amount Blended (g) | X | Y | Z | X | Y | Z |
| C1-MA | 18 | 18 | 18 | 18 | 18 | 18 |
| C18-MA | 42 | 42 | 42 | 42 | 42 | 42 |
| 2EH-MA | — | — | — | — | — | — |
| C12-MA | — | — | — | — | — | — |
| C22-MA | — | — | — | — | — | — |
| X, Y, Z | 0.14 | 0.18 | 0.23 | 0.74 | 0.81 | 1.41 |
| CDTBA | — | — | — | — | — | — |
| AIBN | — | — | — | — | — | — |
| Synthesis Condition | 2-2 | 2-2 | 2-2 | 2-2 | 2-2 | 2-2 |
| Yield (%) | 98.9 | 98.1 | 98.2 | 97.2 | 97.8 | 96.9 |

TABLE 12

| | Example 2-1 | Example 2-2 | Example 2-3 | Example 2-4 | Example 2-5 | Example 2-6 |
|---|---|---|---|---|---|---|
| Initiator | X | Y | Z | X | Y | Z |
| Alkyl(meth)acrylate Blending Ratio (mass %) | | | | | | |
| C1-MA | 30 | 30 | 30 | 30 | 30 | 30 |
| C18-MA | 70 | 70 | 70 | 70 | 70 | 70 |
| 2EH-MA | — | — | — | — | — | — |
| C12-MA | — | — | — | — | — | — |
| C22-MA | — | — | — | — | — | — |
| Mw | 97,000 | 89,000 | 95,000 | 18,000 | 19,000 | 19,500 |
| Mn | 64,000 | 58,000 | 61,000 | 12,000 | 13,000 | 13,000 |
| Mw/Mn | 1.51 | 1.53 | 1.55 | 1.45 | 1.47 | 1.48 |
| Mw per One Arm Portion | 32,000 | 22,000 | 15,800 | 6,000 | 4,800 | 3,300 |
| Blending Proportion in Lubricating oil composition (mass %) | | | | | | |
| Base Oil | Balance | Balance | Balance | Balance | Balance | Balance |
| Performance Additive | 12.0 | 12.0 | 12.0 | 12.0 | 12.0 | 12.0 |
| Viscosity Index Improver | 2.2 | 2.3 | 2.4 | 3.2 | 3.1 | 3.3 |
| Kinematic Viscosity ($mm^2/s$)/100° C. | 5.83 | 5.85 | 5.79 | 5.81 | 5.79 | 5.85 |
| Viscosity Index | 159 | 161 | 162 | 159 | 155 | 156 |
| Friction Coefficient by Two Cylinder Test | 0.029 | 0.028 | 0.029 | 0.027 | 0.026 | 0.028 |
| Shear Rate (%) | 5.2 | 5.5 | 5.1 | 2.1 | 2.5 | 2.3 |

TABLE 14

| | Example 2-7 | Example 2-8 | Example 2-9 | Example 2-10 | Example 2-11 | Example 2-12 |
|---|---|---|---|---|---|---|
| Initiator | X | Y | Z | X | Y | Z |
| Alkyl(meth)acrylate Blending Ratio (mass %) | | | | | | |
| C1-MA | 30 | 30 | 30 | 30 | 30 | 30 |
| C18-MA | 70 | 70 | 70 | 70 | 70 | 70 |
| 2EH-MA | — | — | — | — | — | — |
| C12-MA | — | — | — | — | — | — |
| C22-MA | — | — | — | — | — | — |
| Mw | 98,000 | 91,000 | 97,000 | 19,000 | 17,000 | 18,000 |
| Mn | 80,300 | 74,000 | 77,600 | 18,400 | 16,000 | 16,100 |
| Mw/Mn | 1.22 | 1.23 | 1.25 | 1.03 | 1.06 | 1.12 |
| Mw per One Arm Portion | 33,000 | 24,500 | 16,000 | 6,300 | 4,300 | 3,000 |
| Blending Proportion in Lubricating oil composition (mass %) | | | | | | |
| Base Oil | Balance | Balance | Balance | Balance | Balance | Balance |
| Performance Additive | 12.0 | 12.0 | 12.0 | 12.0 | 12.0 | 12.0 |
| Viscosity Index Improver | 2.0 | 2.1 | 2.2 | 3.3 | 3.3 | 3.1 |
| Kinematic Viscosity ($mm^2/s$)/100° C. | 5.83 | 5.85 | 5.79 | 5.81 | 5.79 | 5.83 |
| Viscosity Index | 159 | 161 | 162 | 159 | 155 | 156 |
| Friction Coefficient by Two Cylinder Test | 0.025 | 0.023 | 0.024 | 0.026 | 0.025 | 0.027 |
| Shear Rate (%) | 5.1 | 4.8 | 5.3 | 2.4 | 2.3 | 2.1 |

TABLE 15

| | Example 2-13 | Example 2-14 | Example 2-15 | Example 2-16 | Example 2-17 | Example 2-18 |
|---|---|---|---|---|---|---|
| Initiator | X | Y | Z | X | Y | Z |
| Amount Blended (g) | | | | | | |
| C1-MA | 12 | 12 | 12 | 27 | 27 | 27 |
| C18-MA | 48 | 48 | 48 | 33 | 33 | 33 |
| 2EH-MA | — | — | — | — | — | — |
| C12-MA | — | — | — | — | — | — |

TABLE 15-continued

| | Example 2-13 | Example 2-14 | Example 2-15 | Example 2-16 | Example 2-17 | Example 2-18 |
|---|---|---|---|---|---|---|
| C22-MA | — | — | — | — | — | — |
| X, Y, Z | 0.14 | 0.18 | 0.23 | 0.74 | 0.81 | 1.42 |
| CDTBA | — | — | — | — | — | — |
| AIBN | — | — | — | — | — | — |
| Synthesis Condition | 2-2 | 2-2 | 2-2 | 2-2 | 2-2 | 2-2 |
| Yield (%) | 98.5 | 98.3 | 98.8 | 96.9 | 97.2 | 95.9 |

TABLE 16

| | Example 2-13 | Example 2-14 | Example 2-15 | Example 2-16 | Example 2-17 | Example 2-18 |
|---|---|---|---|---|---|---|
| Initiator | X | Y | Z | X | Y | Z |
| Alkyl(meth)acrylate Blending Ratio (mass %) | | | | | | |
| C1-MA | 20 | 20 | 20 | 45 | 45 | 45 |
| C18-MA | 80 | 80 | 80 | 55 | 55 | 55 |
| 2EH-MA | — | — | — | — | — | — |
| C12-MA | — | — | — | — | — | — |
| C22-MA | — | — | — | — | — | — |
| Mw | 98,000 | 91,000 | 97,000 | 19,000 | 17,000 | 18,000 |
| Mn | 77,800 | 73,400 | 78,000 | 16,800 | 15,800 | 16,200 |
| Mw/Mn | 1.26 | 1.24 | 1.24 | 1.13 | 1.07 | 1.11 |
| Mw per One Arn Portion | 33,000 | 22,800 | 16,200 | 6,300 | 4,300 | 3,000 |
| Blending Proportion in Lubricating oil composition (mass %) | | | | | | |
| Base Oil | Balance | Balance | Balance | Balance | Balance | Balance |
| Performance Additive | 12.0 | 12.0 | 12.0 | 12.0 | 12.0 | 12.0 |
| Viscosity Index Improver | 2.2 | 2.0 | 2.1 | 3.5 | 3.4 | 3.1 |
| Kinematic Viscosity (mm/s)/100° C. | 5.83 | 5.85 | 5.79 | 5.81 | 5.79 | 5.83 |
| Viscosity Index | 159 | 161 | 162 | 159 | 155 | 156 |

TABLE 16-continued

| | Example 2-13 | Example 2-14 | Example 2-15 | Example 2-16 | Example 2-17 | Example 2-18 |
|---|---|---|---|---|---|---|
| Friction Coefficient by Two Cylinder Test | 0.029 | 0.028 | 0.031 | 0.025 | 0.023 | 0.024 |
| Shear Rate (%) | 4.9 | 5.1 | 5.2 | 2.4 | 2.3 | 2.2 |

TABLE 17

| | Example 2-19 | Example 2-20 | Example 2-21 | Example 2-22 | Example 2-23 | Example 2-24 |
|---|---|---|---|---|---|---|
| Initiator Amount Blended (g) | X | Y | Z | X | Y | Z |
| C1-MA | 24 | 24 | 24 | 24 | 24 | 24 |
| C18-MA | 18 | 18 | 18 | 18 | 18 | 18 |
| 2EH-MA | 9 | 9 | 9 | 9 | 9 | 9 |
| C12-MA | — | — | — | — | — | — |
| C22-MA | 9 | 9 | 9 | 9 | 9 | 9 |
| X, Y, Z | 0.37 | 0.49 | 0.68 | 0.38 | 0.47 | 0.66 |
| CDTBA | — | — | — | — | — | — |
| AIBN | — | — | — | — | — | — |
| Synthesis Condition | 2-2 | 2-2 | 2-2 | 2-2 | 2-2 | 2-2 |
| Yield (%) | 98.8 | 98.1 | 98.9 | 96.1 | 97.8 | 96.2 |

TABLE 19

| | Example 2-25 | Example 2-26 | Example 2-27 | Example 2-28 |
|---|---|---|---|---|
| Initiator Amount Blended (g) | X | Z | X | Z |
| C1-MA | 9 | 9 | 24 | 24 |
| C18-MA | 51 | 51 | 15 | 15 |
| 2EH-MA | — | — | — | — |
| C12-MA | — | — | 12 | 12 |
| C22-MA | — | — | 9 | 9 |
| X, Y, Z | 0.38 | 0.66 | 0.74 | 1.42 |
| CDTBA | — | — | — | — |
| AIBN | — | — | — | — |
| Synthesis Condition | 2-2 | 2-2 | 2-2 | 2-2 |
| Yield (%) | 95.2 | 95.6 | 94.8 | 95.9 |

TABLE 18

| | Example 2-19 | Example 2-20 | Example 2-21 | Example 2-22 | Example 2-23 | Example 2-24 |
|---|---|---|---|---|---|---|
| Initiator | X | Y | Z | X | Y | Z |
| Alkyl(meth)acrylate Blending Ratio (mass %) | | | | | | |
| C1-MA | 40 | 40 | 40 | 40 | 40 | 40 |
| C18-MA | 30 | 30 | 30 | 30 | 30 | 30 |
| 2EH-MA | 15 | 15 | 15 | 15 | 15 | 15 |
| C12-MA | — | — | — | — | — | — |
| C22-MA | 15 | 15 | 15 | 15 | 15 | 15 |
| Mw | 53,000 | 51,000 | 55,000 | 59,000 | 57,000 | 53,000 |
| Mn | 45,000 | 45,500 | 46,600 | 57,000 | 54,300 | 45,000 |
| Mw/Mn | 1.18 | 1.12 | 1.19 | 1.03 | 1.05 | 1.18 |
| Mw per One Arm Portion | 17,700 | 12,800 | 9,200 | 19,700 | 14,300 | 8,800 |
| Blending Proportion in Lubricating oil composition (mass %) | | | | | | |
| Base Oil | Balance | Balance | Balance | Balance | Balance | Balance |
| Performance Additive | 12.0 | 12.0 | 12.0 | 12.0 | 12.0 | 12.0 |
| Viscosity Index Improver | 2.5 | 2.7 | 2.6 | 2.4 | 2.5 | 2.6 |
| Kinematic Viscosity ($mm^2/s$)/100° C. | 5.83 | 5.85 | 5.79 | 5.81 | 5.79 | 5.83 |
| Viscosity Index | 159 | 161 | 162 | 159 | 155 | 156 |
| Friction Coefficient by Two Cylinder Test | 0.021 | 0.022 | 0.019 | 0.022 | 0.021 | 0.019 |
| Shear Rate (%) | 3.8 | 3.5 | 3.7 | 3.6 | 3.2 | 3.8 |

TABLE 20

| | Example 2-25 | Example 2-26 | Example 2-27 | Example 2-28 |
|---|---|---|---|---|
| Initiator | X | Z | X | Z |
| Alkyl(meth)acrylate Blending Ratio (mass %) | | | | |
| C1-MA | 15 | 15 | 40 | 40 |
| C18-MA | 85 | 85 | 25 | 25 |
| 2EH-MA | — | — | — | — |
| C12-MA | — | — | 20 | 20 |
| C22-MA | — | — | 15 | 15 |
| Mw | 52,000 | 57,000 | 18,000 | 19,000 |
| Mn | 41,600 | 48,000 | 14,800 | 14,000 |
| Mw/Mn | 1.25 | 1.18 | 1.22 | 1.33 |
| Mw per One Arm Portion | 17,000 | 9,500 | 6,000 | 3,200 |
| Blending Proportion in Lubricating oil composition (mass %) | | | | |
| Base Oil | Balance | Balance | Balance | Balance |
| Performance Additive | 12.0 | 12.0 | 12.0 | 12.0 |
| Viscosity Index Improver | 2.7 | 2.6 | 3.1 | 3.4 |
| Kinematic Viscosity ($mm^2/s$)/100° C. | 5.83 | 5.85 | 5.79 | 5.81 |
| Viscosity Index | 159 | 161 | 162 | 159 |
| Friction Coefficient by Two Cylinder Test | 0.024 | 0.0225 | 0.022 | 0.021 |
| Shear Rate (%) | 3.6 | 3.8 | 2.2 | 2.1 |

TABLE 21

| | Comp. Ex. 2-1 | Comp. Ex. 2-2 | Comp. Ex. 2-3 | Comp. Ex. 2-4 | Comp. Ex. 2-5 | Comp. Ex. 2-6 |
|---|---|---|---|---|---|---|
| Initiator | X | Z | CDTBA | CDTBA | AIBN | AIBN |
| Amount Blended (g) | | | | | | |
| C1-MA | 24 | 24 | 24 | 24 | 24 | 24 |
| C18-MA | 36 | 36 | 36 | 36 | 36 | 36 |
| 2EH-MA | — | — | — | — | — | — |
| C12-MA | — | — | — | — | — | — |
| C22-MA | — | — | — | — | — | — |
| X, Y, Z | 0.13 | 1.43 | — | — | — | — |
| CDTBA | — | — | 0.65 | 3.8 | — | — |
| AIBN | — | — | 0.06 | 0.06 | 0.24 | 0.24 |
| Synthesis Condition | 2-1 | 2-2 | 2-3 | 2-3 | 2-4 | 2-4 |
| Yield (%) | 95.1 | 95.8 | 96.8 | 96.9 | 94.1 | 95.9 |

TABLE 22

| | Comp. Ex. 2-1 | Comp. Ex. 2-2 | Comp. Ex. 2-3 | Comp. Ex. 2-4 | Comp. Ex. 2-5 | Comp. Ex. 2-6 |
|---|---|---|---|---|---|---|
| Initiator | X | Z | CDTBA | CDTBA | AIBN | AIBN |
| Alkyl(meth)acrylate Blending Ratio (mass %) | | | | | | |
| C1-MA | 40 | 40 | 40 | 40 | 40 | 40 |
| C18-MA | 60 | 60 | 60 | 60 | 60 | 60 |
| 2EH-MA | — | — | — | — | — | — |
| C12-MA | — | — | — | — | — | — |
| C22-MA | — | — | — | — | — | — |
| Mw | 108,000 | 18,000 | 90,000 | 19,000 | 97,000 | 17,000 |
| Mn | 94,000 | 10,800 | 54,000 | 11,600 | 42,500 | 7,700 |
| Mw/Mn | 1.15 | 1.67 | 1.71 | 1.63 | 2.28 | 2.21 |
| Mw per One Arm Portion | 36,000 | 3,000 | — | — | — | — |

TABLE 22-continued

| | Comp. Ex. 2-1 | Comp. Ex. 2-2 | Comp. Ex. 2-3 | Comp. Ex. 2-4 | Comp. Ex. 2-5 | Comp. Ex. 2-6 |
|---|---|---|---|---|---|---|
| Blending Proportion in Lubricating oil composition (mass %) | | | | | | |
| Base Oil | Balance | Balance | Balance | Balance | Balance | Balance |
| Performance Additive | 12.0 | 12.0 | 12.0 | 12.0 | 12.0 | 12.0 |
| Viscosity Index Improver | 1.8 | 3.3 | 1.9 | 3.4 | 2.0 | 3.2 |
| Kinematic Viscosity ($mm^2/s$)/100° C. | 5.85 | 5.89 | 5.71 | 5.73 | 5.81 | 5.86 |
| Viscosity Index | 163 | 158 | 157 | 155 | 163 | 159 |
| Friction Coefficient by Two Cylinder Test | 0.043 | 0.048 | 0.042 | 0.044 | 0.049 | 0.048 |
| Shear Rate (%) | 10.2 | 5.8 | 9.9 | 6.8 | 10.8 | 5.9 |

The invention claimed is:

1. A lubricating oil composition comprising:

a lubricating base oil; and a poly(meth)acrylate-based viscosity index improver comprising:

a core portion derived from a compound having three or more functional groups that react with a carbon-carbon double bond of an acryloyl group chosen from the group consisting of 1,1,1-tris(2-bromoisobutyloxymethylene)ethane, pentaerythritoltetrakis(2-bromoisobutyrate), and dipentaerythritolhexakis(2-bromoisobutyrate); and three or more arm portions, wherein each of the arm portions consists of a polymer chain consisting of structural units represented by formula (1) shown below, and one end of the polymer chain is bonded to the core portion, (1)

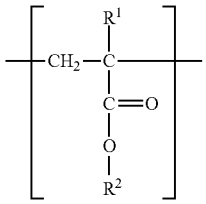

wherein $R^1$ represents a hydrogen or a methyl group, and $R^2$ represents a C1 to C36 alkyl group, wherein the polymer chain comprises 20 to 45 mass % of the structural unit wherein $R^2$ is a methyl group and 20 mass % or more of the structural unit wherein $R^2$ is an alkyl group having 18 or more carbon atoms, based on the total amount of the structural units contained in the polymer chain, and wherein the ratio of the weight-average molecular weight Mw to the number average molecular weight Mn of the poly(meth)acrylate-based viscosity index improver, Mw/Mn, is 1.6 or less.

2. The lubricating oil composition according to claim 1, wherein the weight-average molecular weight, Mw, of the poly(meth)acrylate-based viscosity index improver is 100000 or more.

3. The lubricating oil composition according to claim 1, wherein the weight-average molecular weight, Mw, of the poly(meth)acrylate-based viscosity index improver is less than 100000.

* * * * *